US009354535B2

(12) United States Patent
Kouyama et al.

(10) Patent No.: US 9,354,535 B2
(45) Date of Patent: May 31, 2016

(54) TONER FOR ELECTROSTATIC CHARGE IMAGE DEVELOPMENT AND METHOD FOR MANUFACTURING THE SAME

(71) Applicant: Konica Minolta, Inc., Tokyo (JP)

(72) Inventors: Mikio Kouyama, Kunitachi (JP); Natsuko Fujisaki, Hino (JP); Asao Matsushima, Hino (JP); Ken Ohmura, Hachioji (JP); Tatsuya Nagase, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/616,212

(22) Filed: Feb. 6, 2015

(65) Prior Publication Data

US 2015/0234306 A1 Aug. 20, 2015

(30) Foreign Application Priority Data

Feb. 17, 2014 (JP) ..... 2014-027304

(51) Int. Cl.
*G03G 9/087* (2006.01)

(52) U.S. Cl.
CPC ..... *G03G 9/08764* (2013.01); *G03G 9/08795* (2013.01); *G03G 9/08797* (2013.01)

(58) Field of Classification Search
CPC ..... G03G 9/08755
See application file for complete search history.

(56) References Cited

U.S. PATENT DOCUMENTS

2014/0051019 A1* 2/2014 Sekiguchi ..... G03G 9/08764 430/105
2014/0065534 A1* 3/2014 Amemori ..... G03G 9/08782 430/105
2014/0080051 A1* 3/2014 Sawada ..... G03G 9/08764 430/109.5

FOREIGN PATENT DOCUMENTS

JP 2012-133161 A 7/2012
JP 2015014644 A 1/2015

OTHER PUBLICATIONS

Notification of Reasons for Refusal: Application No. 2014-027304; Date of Drafting: Jan. 13, 2016; Applicant: OI, Masahiko; Applied Provisions: Article 29bis, Article 36; total of 2 pages; English translation of Notification of Reasons for Refusal; total of 2 pages; Grand Total of 4 pages.

* cited by examiner

*Primary Examiner* — Hoa V Le
(74) *Attorney, Agent, or Firm* — Lucas & Mercanti, LLP

(57) ABSTRACT

To provide a toner for electrostatic charge image development which allows obtainment of excellent low temperature fixability and a document off-set resistance sufficiently and also inhibition of an excessive increase in glossiness of a formed fixed image, and a method for manufacturing the same.
The toner for electrostatic charge image development includes toner particles containing a binder resin, a colorant, and a releasing agent, in which the binder resin contains at least an amorphous resin and an urethane modified crystalline resin including a crystalline polymer segment and an urethane polymer segment bound to each other, the urethane modified crystalline resin being non-compatible with the amorphous resin, and the amount of ionic dissociating group of the urethane modified crystalline resin is 5 to 20 mgKOH/g.

8 Claims, No Drawings

TONER FOR ELECTROSTATIC CHARGE IMAGE DEVELOPMENT AND METHOD FOR MANUFACTURING THE SAME

CROSS-REFERENCE TO RELATED APPLICATION

This application is based on Japanese Patent Application No. 2014-027304 filed on Feb. 17, 2014, the contents of which are incorporated herein by reference.

BACKGROUND

1. Technical Field

The present invention relates to a toner for electrostatic charge image development used for forming an image by electrophotographic method and a method for manufacturing the same.

2. Description of Related Art

With regard to a toner for electrostatic charge image development used for forming an image by electrophotographic method (hereinbelow, also simply referred to as a toner), it is desired to have a toner with further improved low temperature fixability, from the viewpoint of saving energy or obtaining high speed of an image forming apparatus. As such a toner, a toner, designed in such a manner that, for example, as a binder resin, a crystalline polyester resin having a sharp melt property is introduced to a toner such that the binder resin has a lower glass transition point or lower melt viscosity, is known.

According to a toner in which a crystalline polyester resin having low melt viscosity is used, there is a problem that heat resistant storability is not obtained sufficiently even though the low temperature fixability is obtained.

In order to solve such a problem, a toner including toner particles in which urethane modified crystalline polyester resin particles having a polyester polymer segment and an urethane polymer segment bound to each other are laminated on a surface of parent toner particles has been suggested (see, Japanese Patent Application Publication No. 2012-133161, for example).

However, the toner disclosed in Japanese Patent Application Publication No. 2012-133161 has a problem that, due to low melt viscosity of the polyester polymer segment, glossiness of a fixed image to be obtained is excessively high or there is an occurrence of document off-set.

SUMMARY

The present invention is devised in consideration of the circumstances described above, and an object of the invention is to provide a toner for electrostatic charge image development which allows obtainment of excellent low temperature fixability and a sufficient document off-set resistance and also inhibition of an excessive increase in glossiness of a formed fixed image, and a method for manufacturing the same.

To archive at least one of the abovementioned objects, a toner for electrostatic charge image development reflecting one aspect of the present invention provides a toner for electrostatic charge image development including toner particles containing a binder resin, a colorant, and a releasing agent, wherein the binder resin contains at least an amorphous resin and an urethane modified crystalline resin including a crystalline polymer segment and an urethane polymer segment bound to each other, the urethane modified crystalline resin being non-compatible with the amorphous resin, and the amount of an ionic dissociating group of the urethane modified crystalline resin is 5 to 20 mgKOH/g.

In the above toner for electrostatic charge image development, the following relational formula (1) is preferably satisfied when a glass transition point of the amorphous resin is TgA, a melting point of the urethane modified crystalline resin is TmC, and a melting point of the releasing agent is TmW:

$$TgA \leq TmC < TmW. \quad \text{Relational formula (1)}$$

In the above toner for electrostatic charge image development, the following relational formula (2) and relational formula (3) are preferably satisfied when an endothermic amount of the toner for electrostatic charge image development, which is based on an endothermic peak derived from the urethane modified crystalline resin during a first temperature increasing process for increasing the temperature from 0° C. to 200° C. in differential scanning calorimetry, is ΔH1 (J/g), an endothermic amount of the toner for electrostatic charge image development, which is based on an endothermic peak derived from the urethane modified crystalline resin during a second temperature increasing process for increasing the temperature from 0° C. to 200° C. in differential scanning calorimetry, is ΔH2 (J/g), an endothermic amount of the urethane modified crystalline resin only, which is based on an endothermic peak during the second temperature increasing process for increasing the temperature from 0° C. to 200° C. in differential scanning calorimetry, is ΔH0 (J/g), and a content ratio of the urethane modified crystalline resin in the toner particles is A (% by mass):

$$0.75 \leq \Delta H1/(\Delta H0 \times (A/100)) \leq 1.0 \quad \text{Relational formula (2)}$$

$$0.75 \leq \Delta H2/\Delta H1 \leq 1.0. \quad \text{Relational formula (3)}$$

In the above toner for electrostatic charge image development, a carboxylic acid group and/or a sulfonic acid group is preferably included at a molecular terminal of the urethane modified crystalline resin and/or in the urethane polymer segment constituting the urethane modified crystalline resin.

In the above toner for electrostatic charge image development, the peak temperature of an endothermic peak derived from the urethane modified crystalline resin during a second temperature increasing process for increasing the temperature from 0° C. to 200° C. in differential scanning calorimetry of the urethane modified crystalline resin only is preferably in the range of 50 to 85° C.

In the above toner for electrostatic charge image development, the crystalline polymer segment constituting the urethane modified crystalline resin preferably includes a crystalline polyester polymer.

In the above toner for electrostatic charge image development, the amorphous resin is preferably a styrene acrylic resin and/or a polyester resin.

To archive at least one of the abovementioned objects, a method for manufacturing a toner for electrostatic charge image development reflecting one aspect of the present invention provides a method for manufacturing a toner for electrostatic charge image development including toner particles containing a binder resin, a colorant, and a releasing agent, the method including:

aggregating and fusing microparticles including an amorphous resin for forming the binder resin and microparticles including an urethane modified crystalline resin for forming the binder resin, which is obtained by binding between a crystalline polymer segment and an urethane polymer segment and is non-compatible with the amorphous resin, the microparticles being dispersed in an aqueous medium, and using, as the urethane modified crystalline resin, a resin having an ionic dissociating group amount of 5 to 20 mgKOH/g.

According to the toner for electrostatic charge image development of the present invention, an amorphous resin and an urethane modified crystalline resin including a crystalline polymer segment and an urethane polymer segment bound to each other, in which the urethane modified crystalline resin is non-compatible with the amorphous resin and has a specific amount of ionic dissociating group, are contained in a binder resin. As a result, not only excellent low temperature fixability is obtained but also a document off-set resistance is obtained sufficiently while an excessive increase in glossiness of a formed fixed image is inhibited.

DETAILED DESCRIPTION

Hereinbelow, the present invention will be described in detail.

The toner of the present invention includes toner particles containing a binder resin, a colorant, and a releasing agent, in which the binder resin contains at least an amorphous resin and an urethane modified crystalline resin including a crystalline polymer segment and an urethane polymer segment bound to each other, the urethane modified crystalline resin being non-compatible with the amorphous resin, characterized in that the amount of ionic dissociating group of the urethane modified crystalline resin is 5 to 20 mgKOH/g.

Since the toner described above contains a binder resin containing an amorphous resin and an urethane modified crystalline resin including a crystalline polymer segment and an urethane polymer segment bound to each other, in which the urethane modified crystalline resin is non-compatible with the amorphous resin and has a specific amount of ionic dissociating group, not only excellent low temperature fixability is obtained but also a sufficient document off-set resistance is obtained while an excessive increase in glossiness of an formed fixed image is inhibited.

The reason is believed to be as follows. Namely, due to the presence of the crystalline polymer segment contained in the urethane modified crystalline resin, a sufficient sharp melting property is obtained, and thus excellent low temperature fixability can be obtained. Meanwhile, due to the presence of the urethane polymer segment contained in the urethane modified crystalline resin, sufficient viscoelasticity of the binder resin is maintained as a whole even under high temperature for thermal fixing, and thus an excessive increase in glossiness of a formed fixed image is inhibited and also a sufficient document off-set resistance is obtained.

[Binder Resin]

The binder resin constituting the toner particles according to the present invention contains at least an amorphous resin and an urethane modified crystalline resin including a crystalline polymer segment and an urethane polymer segment bound each other, in which the urethane modified crystalline resin is non-compatible with the amorphous resin.

The non-compatibility between the amorphous resin and urethane modified crystalline resin means substantial non-compatibility. Specifically, when an endothermic amount of the urethane modified crystalline resin only, which is based on an endothermic peak derived from the urethane modified crystalline resin during a second temperature increasing process for increasing the temperature from 0° C. to 200° C., is ΔH0 (J/g) based on differential scanning calorimetry, an endothermic amount of the toner, which is based on an endothermic peak derived from the urethane modified crystalline resin during a first temperature increasing process for increasing the temperature from 0° C. to 200° C., is ΔH1 (J/g) based on differential scanning calorimetry, an endothermic amount of the toner, which is based on an endothermic peak derived from the urethane modified crystalline resin during a second temperature increasing process for increasing the temperature from 0° C. to 200° C., is ΔH2 (J/g) based on differential scanning calorimetry, and a content ratio of the urethane modified crystalline resin in the toner particles is A (% by mass), the following relational formula (2) and relational formula (3) are satisfied:

$$0.75 \leq \Delta H1/(\Delta H0 \times (A/100)) \leq 1.0 \quad \text{Relational formula (2)}$$

$$0.75 \leq \Delta H2/\Delta H1 \leq 1.0. \quad \text{Relational formula (3)}$$

The value of ΔH1/(ΔH0×(A/100)) according to the relational formula (2) is more preferably 0.85≤ΔH1/(ΔH0×(A/100))≤1.0, and even more preferably 0.90≤ΔH1/(ΔH0×(A/100))≤0.99.

The value of ΔH2/ΔH1 according to the relational formula (3) is more preferably 0.80≤ΔH2/ΔH1≤1.0, and even more preferably 0.90≤ΔH2/ΔH1≤1.0.

When both the relational formula (2) and the relational formula (3) described above are satisfied, a state in which a blending exists at an interface between domains of both resins in the toner particles such that sufficient strength can be maintained while the main part of the domains is not mixed with each other can be obtained. Specifically, when the toner is manufactured by using an emulsion aggregation method described below, a state having no occurrence of fusion or the like among the toner particles, which is caused by a decrease in glass transition point due to compatibility among microparticles of both resins during a step for aggregation and fusion for forming the toner particles, but having fusion among microparticles of both resins for allowing sufficient mechanical strength of the toner particles is yielded.

Differential scanning calorimetry is performed as following conditions: by using "DIAMOND DSC", the first temperature increasing process by which the temperature is increased from 0° C. to 200° C. at a temperature increase rate of 10° C./minute is performed followed by maintaining for 1 minute at 200° C., a cooling process by which the temperature is decreased from 200° C. to 0° C. at a temperature decrease rate of 10° C./minute is performed followed by further maintaining for 1 minute at 0° C., and the second temperature increasing process by which the temperature is increased from 0° C. to 200° C. at a temperature increase rate of 10° C./minute is performed. Measurement order is as follows. 3.0 mg of the urethane modified crystalline resin is sealed in an aluminum pan and set in a sample holder of "DIAMOND DSC". An empty aluminum pan is used as a reference.

[Urethane Modified Crystalline Resin]

The urethane modified crystalline resin is a crystalline resin including a block copolymer which is obtained by binding between an urethane polymer segment and a crystalline polymer segment, As described herein, the crystalline resin indicates a resin having a clear endothermic peak, not a step-like change in endothermic amount, according to the differential scanning calorimetry (DSC). The clear endothermic peak specifically means a peak with the half width of 15° C. or lower in an endothermic peak when the differential scanning calorimetry (DSC) is measured at a temperature increase rate of 10° C./min.

[Melting Point of Urethane Modified Crystalline Resin]

The melting point of the urethane modified crystalline resin is preferably 40 to 100° C., and more preferably 50 to 85° C.

As the melting point of the urethane modified crystalline resin is within the above range, sufficient low temperature fixability is surely obtained.

Herein, the melting point of the urethane modified crystalline resin is the peak temperature of an endothermic peak during the first temperature increasing process in the aforementioned differential scanning calorimetry (DSC) of the urethane modified crystalline resin only.

Further, the peak temperature of an endothermic peak during the second temperature increasing process in the aforementioned differential scanning calorimetry (DSC) of the urethane modified crystalline resin only is preferably in the range of 50 to 85° C.

When the peak temperature of an endothermic peak during the second temperature increasing process for the urethane modified crystalline resin is within the range described above, both the low temperature fixability and heat resistant storability can be surely obtained.

[Amount of Ionic Dissociating Group in Urethane Modified Crystalline Resin]

The amount of ionic dissociating group of the urethane modified crystalline resin is 5 to 20 mgKOH/g.

When the amount of ionic dissociating group of the urethane modified crystalline resin is 20 mgKOH/g or less, a suitably large average particle diameter of microparticles of the urethane modified crystalline resin, which are formed during the process for preparing a dispersion of urethane modified crystalline resin microparticles for manufacturing a toner described below, is obtained. As a result, the progress of aggregation among urethane modified crystalline resin microparticles can be inhibited during the step for aggregation and fusion. As such, not only a predetermined sufficient addition amount of the urethane modified crystalline resin can be included in the toner particles but also rapid aggregation of the microparticles during the step for aggregation and fusion can be inhibited. Thus, the average toner particle diameter can be surely controlled. Meanwhile, as the amount of ionic dissociating group of the urethane modified crystalline resin is 5 mgKOH/g or more, urethane modified crystalline resin microparticles, which are formed by the step for preparing a dispersion of urethane modified crystalline resin microparticles for manufacturing a toner described below, can have sufficient dispersion stability in an aqueous medium, and therefore an occurrence of unintended aggregation, precipitation, or the like of the urethane modified crystalline resin microparticles can be suppressed.

As described herein, the ionic dissociating group means a carboxylic acid group or a sulfonic acid group.

The amount of ionic dissociating group in the urethane modified crystalline resin is measured according to the method for measuring acid value described in JIS K0070. Specifically, the urethane modified crystalline resin is dissolved in a mixture solvent of acetone:water=1:1, and by performing neutralization titration using potassium hydroxide according to a general method, the amount of potassium hydroxide used until the endpoint of neutralization is obtained is expressed as grams per gram of the resin. It has an unit of mgKOH/g.

[Molecular Weight of Urethane Modified Crystalline Resin]

The weight average molecular weight (Mw) of the urethane modified crystalline resin calculated from molecular weight distribution, which is measured by gel permeation chromatography (GPC), is preferably 5,000 to 100,000, more preferably 6,000 to 90,000, still more preferably 7,000 to 70,000, and particularly preferably 8,000 to 60,000.

Measurement of the molecular weight by GPC is performed as described below. Specifically, the apparatus "HLC-8220" (manufactured by TOSOH CORPORATION) and the column "TSK guard column+TSK gel Super HZM-M3 series" (manufactured by TOSOH CORPORATION) are used, tetrahydrofuran (THF) is added as a carrier solvent at a flow rate of 0.2 ml/min while maintaining the column temperature at 40° C., a measurement sample (urethane modified crystalline resin) is dissolved in tetrahydrofuran to have a concentration of 1 mg/ml under dissolving conditions including 5-minute treatment with an ultrasonic disperser at room temperature, a sample solution is obtained subsequently by treating with a membrane filter with a pore size of 0.2 m, 10 L of the sample solution is injected to the device together with the carrier solvent, the detection is made by using a refractive index detector (RI detector), and molecular weight distribution of the measurement sample is calculated by using a calibration curve which is established by using standard mono-dispersed polystyrene particles. As a standard polystyrene sample for measurement based on a calibration curve, those having molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^6$ (manufactured by Pressure Chemical Company) are used and at least ten points of the standard polystyrene sample were used for establishing a calibration curve. Further, as a detector, a refractivity index detector was used.

The weight average molecular weight (Mw) of the urethane polymer segment constituting the urethane modified crystalline resin calculated from molecular weight distribution which is measured by gel permeation chromatography (GPC), is preferably 500 to 50,000, more preferably 750 to 20,000, and still more preferably 1,000 to 10,000.

The measurement of the molecular weight distribution of the urethane polymer segment by GPC is performed in the same manner as above except that the urethane polymer segment is used as a measurement sample.

Further, the weight average molecular weight (Mw) of the crystalline polymer segment, constituting the urethane modified crystalline resin calculated from molecular weight distribution which is measured by gel permeation chromatography (GPC), is preferably 2,000 to 80,000, more preferably 4,000 to 60,000, and still more preferably 5,000 to 15,000.

As the weight average molecular weight (Mw) of the crystalline polymer segment constituting the urethane modified crystalline resin is 2,000 or more, sufficient crystallinity is obtained, and thus a predetermined sharp melting property is obtained. Further, as the weight average molecular weight (Mw) is 80,000 or less, melt viscosity is lowered to a suitable level, and thus sufficient sharp melting property is also obtained.

The measurement of the molecular weight distribution of the crystalline polymer segment by GPC is performed in the same manner as above except that the crystalline polymer segment is used as a measurement sample.

According to the present invention, the content ratio of the crystalline polymer segment in the urethane modified crystalline resin is preferably 50 to 99.5% by mass, more preferably 60 to 97% by mass, and particularly preferably 60 to 95% by mass.

The content ratio of the crystalline polymer segment specifically indicates the mass ratio of polyhydric carboxylic acid and polyhydric alcohol to become the crystalline polymer segment relative to the total mass of resin materials that are used for synthesis of the urethane modified crystalline resin, that is, the total mass of the polyhydric carboxylic acid and polyhydric alcohol to become the crystalline polymer segment and the polyhydric alcohol and polyvalent isocyanate to become the urethane polymer segment.

As the content ratio of the crystalline polymer segment is 50% or more, a sufficient sharp melting property is obtained, and excellent low temperature fixability can be obtained. Further, as it is 99.5% by mass or less, sufficient viscoelasticity of the binder resin as a whole is maintained even under high temperature for thermal fixing, and thus an excessive increase in glossiness of a formed fixed image is inhibited and also a sufficient document off-set resistance is obtained.

[Method for Synthesis of Urethane Modified Crystalline Resin]

The urethane modified crystalline resin can be synthesized by synthesizing in advance each of a prepolymer having a hydroxyl group at both terminals (crystalline polyester diol or the like which will be described below) and a polyurethane unit having an isocyanate group at terminal, which become a crystalline polymer segment, followed by mixing and reacting them (Synthetic reaction A).

It is also possible that the urethane modified crystalline resin is synthesized by synthesizing, first, a prepolymer having a hydroxyl group at both terminals (crystalline polyester diol or the like which will be described below), which becomes the crystalline polymer segment, and reacting a polyvalent isocyanate compound only or a polyvalent isocyanate compound and a polyhydric alcohol with the hydroxyl group at both terminals of the pre-polymer (Synthetic reaction B) to form an urethane polymer segment.

The aforementioned Synthetic reaction A is performed in a solvent which can dissolve both the pre-polymer having a hydroxyl group at both terminals and the polyurethane unit having an isocyanate group at terminal. Similarly, the aforementioned Synthetic reaction B is performed in a solvent which can dissolve the polyvalent isocyanate compound and polyhydric alcohol as well as the pre-polymer having a hydroxyl group at both terminals. Such a reaction solvent includes a ketone-based solvent like acetone, methyl ethyl ketone, and methyl isobutyl ketone. The reaction solvent is preferably those obtained after a dehydration treatment to prevent a side reaction.

Further, the aforementioned Synthetic reactions A and B are preferably performed at increased temperature to promote the synthetic reaction. Although the reaction temperature may vary depending on the boiling point of the solvent, it is preferably 50 to 80° C.

[Method for Introducing Ionic Dissociating Group]

The ionic dissociating group in the urethane modified crystalline resin can be introduced to the molecular terminal of the urethane modified crystalline resin and/or the urethane polymer segment constituting the urethane modified crystalline resin.

Specifically, when an ionic dissociating group is introduced to the molecular terminal of the urethane modified crystalline resin, the introduction can be made by an esterification reaction of a polyhydric carboxylic acid compound or a sulfonated carboxylic acid compound with a hydroxyl group at molecular terminal of a product resulting from binding between the crystalline polymer segment and the urethane polymer segment for forming the urethane modified crystalline resin. Examples of the polyhydric carboxylic acid compound include divalent carboxylic acid such as fumaric acid, succinic acid, or adipic acid; and trivalent carboxylic acid such as trimellitic acid anhydride or citric acid. Examples of the sulfonated carboxylic acid compound which may be used include sulfobenzoic acid. The esterification reaction can be performed in the presence of a catalyst. Examples of the catalyst which may be used include tetrabutoxy titanate, dibutyl tin oxide, and p-tolylene sulfonic acid.

Further, when an ionic dissociating group is introduced to the urethane polymer segment, the introduction can be made by performing an urethanization reaction by using a diol compound having a carboxylic acid group and/or a sulfonic acid group as a polyhydric alcohol for forming the urethane polymer segment. Examples of the diol compound include dimethylol acetic acid, dimethylol propionic acid, dimethylol butanoic acid, dihydroxy succinic acid, tartaric acid, glyceric acid, dihydroxybenzoic acid, dihydroxymethane sulfonic acid, dihydroxymethane disulfonic acid, and dihydroxybenzene sulfonic acid.

As for a reaction solvent for performing the esterification reaction or the urethanization reaction, a ketone-based solvent like acetone, methyl ethyl ketone, and methyl isobutyl ketone can be used. It is also preferable to use N-methyl pyrrolidone or the like for dissolving the diol compound. The reaction solvent is preferably those obtained after a dehydration treatment to prevent a side reaction.

[Crystalline Polymer Segment]

The crystalline polymer segment is not limited as long as it includes a polymer having crystallinity. However, those including crystalline polyester diol are preferred, in particular.

The crystalline polyester diol is formed of polyhydric carboxylic acid containing two or more carboxylic acid groups in one molecule and polyhydric alcohol having two or more hydroxyl groups in one molecule, and it has crystallinity and contains a hydroxyl group at both terminals thereof. Specifically, the crystalline polyester diol indicates those having a clear endothermic peak, not a step-like change in endothermic amount, according to the differential scanning calorimetry (DSC).

As for the polyhydric carboxylic acid, aliphatic dicarboxylic acid is preferably used. Aromatic dicarboxylic acid may be also used in combination.

As for the polyhydric carboxylic acid, linear aliphatic dicarboxylic acid in which the carbon number of the main chain which contains the carboxy group is preferably 4 to 12, and the carbon number of the main chain which contains the carboxy group is particularly preferably 6 to 10 is preferably used from the viewpoint of obtaining excellent crystallinity of the crystalline polymer segment.

The polyhydric carboxylic acid can be used either singly or in combination of two or more types.

Examples of the aliphatic dicarboxylic acid include saturated aliphatic dicarboxylic acid such as oxalic acid, malonic acid, fumaric acid, succinic acid, adipic acid, azelaic acid, sebacic acid, dodecanedioic acid, or n-dodecylsuccinic acid; alicyclic dicarboxylic acid such as cyclohexane dicarboxylic acid; aromatic dicarboxylic acid such as phthalic acid, isophthalic acid, or terephthalic acid; trimellitic acid; polyhydric acid with valency of three or higher such as pyromellitic acid; and anhydride or alkyl (with 1 to 3 carbon atoms) ester of the aforementioned dicarboxylic acid.

As for the polyhydric carboxylic acid for forming the crystalline polyester diol, the content of aliphatic carboxylic acid thereof is preferably 80% by constitutional mol or more, and more preferably 90% by constitutional mol or more. As the content of the aliphatic carboxylic acid in polyhydric carboxylic acid is 80% by constitutional mol or more, the crystallinity of the crystalline polyester diol is surely obtained, and thus the toner to be manufactured can be provided with excellent low temperature fixability.

As for the polyhydric alcohol, aliphatic diol is preferably used. As necessary, it is also possible to use in combination a diol other than the aliphatic diol.

As for the polyhydric alcohol, linear aliphatic diol in which carbon number of the main chain is 2 to 15 is preferable, and aliphatic diol in which carbon number of the main chain is 2 to 10 is particularly preferable among the aliphatic diols, from the viewpoint of obtaining excellent crystallinity of the crystalline polymer segment.

The polyhydric alcohol can be used either singly or in combination of two or more types.

Examples of the aliphatic diol include aliphatic diols such as ethylene glycol, 1,2-propane diol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,15-pentadecane diol, 1,18-octadecane diol, 1,20-eicosane diol, neopentyl glycol, or 2-butene-1,4-diol; and polyhydric alcohol with the valency of three or higher such as glycerin, pentaerythritol, trimethylol propane, or sorbitol.

As for the polyhydric alcohol for forming the crystalline polyester diol, the content of aliphatic diol thereof is preferably 80% by constitutional mol or more, and more preferably 90% by constitutional mol or more. As the content of the aliphatic diol in polyhydric alcohol is 80% by constitutional mol or more, the crystallinity of the crystalline polyester diol is surely obtained, and thus the toner to be manufactured can be provided with excellent low temperature fixability.

The method for manufacturing the crystalline polyester diol is not particularly limited, and it can be manufactured by using a general method for polyester polymerization in which the aforementioned polyhydric carboxylic acid is reacted with polyhydric alcohol in the presence of a catalyst. For example, it is preferably manufactured by direct polycondensation or ester exchange method, which is separately applied depending on the type of a monomer.

Examples of the catalyst which can be used for manufacturing the crystalline polyester diol include a titanium catalyst such as titanium tetraethoxide, titanium tetrapropoxide, titanium tetraisopropoxide, or titanium tetrabutoxide, and a tin catalyst such as dibutyl tin dichloride, dibutyl tin oxide, or diphenyl tin oxide.

The use ratio between the polyhydric carboxylic acid and polyhydric alcohol is, in terms of the equivalent ratio of [OH]/[COOH] in which [OH] indicates hydroxyl group of the polyhydric alcohol and [COOH] indicates carboxy group of the polyhydric carboxylic acid, preferably 1.5/1 to 1/1.5, and more preferably 1.2/1 to 1/1.2.

As the use ratio of the polyhydric carboxylic acid and polyhydric alcohol is within the aforementioned range, crystalline polyether diol having a hydroxyl group at both terminals can be obtained.

[Urethane Polymer Segment]

The urethane polymer segment is obtained from polyhydric alcohol and polyvalent isocyanate.

As for the polyhydric alcohol which can be used for forming the urethane polymer segment, those described in the above can be used.

The polyhydric alcohol for forming the urethane polymer segment can be used either singly or in combination of two or more types.

Examples of the polyvalent isocyanate which can be used for forming the urethane polymer segment include aromatic diisocyanate having 6 to 20 carbon atoms (with the proviso that, the carbon in an NCO group is excluded), aliphatic diisocyanate having 2 to 18 carbon atoms, alicyclic diisocyanate having 4 to 15 carbon atoms, araliphatic diisocyanate having 8 to 15 carbon atoms, and a modified product of these diisocyanate.

Polyisocyanate having valency of three or higher may be also used with the aforementioned diisocyanate as a diisocyanate component for obtaining the urethane polymer segment.

The polyvalent isocyanate for forming the urethane polymer segment can be used either singly or in combination of two or more types.

Examples of the aromatic diisocyanate include 1,3- and/or 1,4-phenylene diisocyanate, 2,4- and/or 2,6-tolylene diisocyanate (TDI), 2,4'- and/or 4,4'-diphenylmethane diisocyanate (MDI), polyallyl polyisocyanate (PAPI), 1,5-naphthylene diisocyanate, 4,4',4"-tirphenylmethane triisocyanate, and m- and p-isocyanatophenyl sulfonyl isocyanate, or the like.

Examples of the aliphatic diisocyanate include ethylene diisocyanate, tetramethylene diisocyanate, hexamethylene diisocyanate (HDI), dodemethylene diisocyanate, 1,6,11-undecane diisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-dicyanatohexanoate, or the like.

Examples of the alicyclic diisocyanate include isophorone diisocyanate (IPDI), dicyclohexnylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate and 2,5- and/or 2,6-norbornane diisocyanate, or the like.

Examples of the araliphatic diisocyanate include m- and/or p-xylylene diisocyanate (XDI) and α,α,α', α'-tetramethylxylylene diisocyanate.

Examples of the modified product of diisocyanate include a modified product with an urethane group, a carbodiimide group, an allophanate group, an urea group, a biuret group, an uretdione group, an urethimine group, an isocyanurate group, or an oxazolidone group. Specific examples thereof include urethane modified MDI, urethane modified TDI, carbodiimide modified MDI, and trihydrocarbyl phosphate modified MDI, or the like. These can be used either singly or in combination of two or more types.

The content ratio of the urethane modified crystalline resin in the binder resin is preferably 10 to 50% by mass.

As the content ratio of the urethane modified crystalline resin is 10% by mass or more in the binder resin, sufficient low temperature fixability can be surely obtained. Further, as the content ratio of the urethane modified crystalline resin is 50% by mass or less in the binder resin, the heat resistant storability is obtained.

[Amorphous Resin]

The amorphous resin indicates a resin which is not observed with a clear endothermic peak according to the differential scanning calorimetry (DSC).

The amorphous resin preferably includes a styrene acrylic resin and/or a polyester resin. As for the styrene acrylic resin, a resin having a structural unit derived from an acid monomer like acrylic acid and methacrylic acid is preferably used.

The molecular weight of the amorphous resin, which is measured by gel permeation chromatography (GPC), is preferably 10,000 to 15,000 in terms of number average molecular weight (Mn) and 60,000 to 80,000 in terms of weight average molecular weight (Mw).

As the molecular weight of the amorphous resin is within the aforementioned range, both the sufficiently low temperature fixability and excellent heat resistant storability are surely obtained.

The measurement of the molecular weight of the amorphous resin by GPC is performed in the same manner as above except that the amorphous resin is used as a measurement sample.

The glass transition point of the amorphous resin is preferably 40 to 70° C., and more preferably 50 to 60° C.

As the glass transition point of the amorphous resin is preferably 40° C. or higher, the toner can have sufficient thermal strength so that sufficient heat resistant storability is obtained. Further, as the glass transition point of the amorphous resin is preferably 60° C. or lower, sufficient low temperature fixability is surely obtained.

The glass transition point of the amorphous resin indicates a value which is measured according to the method defined by ASTM (Standards according to American Society for Testing and Materials) D3418-82 (DSC method) using the amorphous resin as a measurement sample.

[Releasing Agent]

The releasing agent is not particularly limited, and various well-known ones can be used. Examples thereof include polyolefin wax such as polyethylene wax or polypropylene wax, branched-chain type hydrocarbon wax such as microcrystalline wax, long chain hydrocarbon wax such as paraffin wax or sasol wax, dialkyl ketone-based wax such as distearyl ketone, ester-based wax such as carnauba wax, montan wax, behenyl behenate, trimethylolpropane tribehenate, pentaerythritol tetrabehenate, pentaerythritol diacetate dibehenate, glycerin tribehenate, 1,18-octadecane diol distearate, tristearyl trimellitate acid, or distearyl maleate, and amide-based wax such as ethylene diamine behenylamide or trimellitic acid tristearylamide.

The content ratio of the releasing agent is preferably 1 to 30 parts by mass, and more preferably 5 to 20 parts by mass relative to 100 parts by mass of the binder resin. As the content ratio of the releasing agent is within the aforementioned range, sufficient fixing separability is obtained.

As for the method for introducing the releasing agent to the toner particles, a method of aggregating and fusing the microparticles composed of a releasing agent only with the amorphous resin microparticles and urethane modified crystalline resin microparticles in an aqueous medium during the step for aggregation and fusion of the method for manufacturing a toner described below can be mentioned. Releasing agent microparticles can be obtained as a dispersion in which a releasing agent is dispersed in an aqueous medium. The dispersion of the releasing agent microparticles can be prepared by heating an aqueous medium containing a surfactant to the temperature higher than the melting point of the releasing agent, adding a solution of the molten releasing agent, and performing microdispersion by applying mechanical energy like mechanical stirring or ultrasonic energy followed by cooling.

Further, when the amorphous resin is a styrene acrylic resin or the like, for example, it is also possible that the releasing agent is blended in advance with the amorphous resin microparticles (styrene acrylic resin microparticles) subjected to the step for aggregation and fusion so that the releasing agent can be introduced to the toner particles. Specifically, a dispersion of amorphous resin microparticles containing a releasing agent can be prepared by a so-called mini-emulsion method in which a releasing agent is dissolved in a solution of polymerizable monomer for forming the styrene acrylic resin and added to an aqueous medium containing a surfactant, microdispersion by applying mechanical energy like mechanical stirring or ultrasonic energy is performed as described in the above, and polymerization is performed at a desired temperature after adding a polymerization initiator.

The toner of the present invention preferably satisfies the relational following formula (1) when the glass transition point of the amorphous resin is TgA, the melting point of the urethane modified crystalline resin is TmC, and the melting point of the releasing agent is TmW:

$$TgA \leq TmC < TmW. \qquad \text{Relational formula (1)}$$

As the above relational formula (1) is satisfied, sufficient low temperature fixability is obtained due to having a sharp melting property, and also an occurrence of a tacking or a document off-set can be surely suppressed.

[Colorant]

As a colorant, a generally known dye and pigment can be used.

As a colorant for obtaining the toner with black color, various well-known kinds including carbon black such as furnace black, or channel black, a magnetic material such as magnetite or ferrite, a dye, and an inorganic pigment containing non-magnetic iron oxide can be arbitrarily used.

As a colorant for obtaining a color toner, various well-known ones such as a dye or an organic pigment can be arbitrarily used. Specific examples of the organic pigment include C.I. Pigment Red 5, C.I. Pigment Red 48:1, C.I. Pigment Red 48:2, C.I. Pigment Red 48:3, C.I. Pigment Red 53:1, C.I. Pigment Red 57:1, C.I. Pigment Red 81:4, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, C.I. Pigment Red 238, C.I. Pigment Red 269, C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, C.I. Pigment Orange 31, C.I. Pigment Orange 43, C.I. Pigment Blue 15:3, C.I. Pigment Blue 60, and C.I. Pigment Blue 76. Specific examples of the dye include C.I. Solvent Red 1, C.I. Solvent Red 49, C.I. Solvent Red 52, C.I. Solvent Red 58, C.I. Solvent Red 68, C.I. Solvent Red 11, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 69, C.I. Solvent Blue 70, C.I. Solvent Blue 93, and C.I. Solvent Blue 95.

The colorant for obtaining a toner with each color can be used either singly or in combination of two or more types for each color.

The content ratio of the colorant is preferably 1 to 20 parts by mass, and more preferably 4 to 15 parts by mass relative to 100 parts by mass of the binder resin.

[Components Constituting Toner Particles]

In the toner particles according to the present invention, as necessary, internal additives such as a charge controlling agent may be added in addition to the binder resin, colorant, and releasing agent.

[Charge Controlling Agent]

Various well-known compounds can be used as a charge controlling agent.

The content ratio of the charge controlling agent is generally 0.1 to 5.0 parts by mass relative to 100 parts by mass of the binder resin.

[Average Particle Diameter of Toner]

The average particle diameter of the toner of the present invention is preferably, for example, 3 to 9 μm in terms of a volume-based median diameter. More preferably, it is 3 to 8 μm. The average particle diameter can be controlled based on a concentration of an aggregating agent or an addition amount of an organic solvent used for manufacture, time for fusion, composition of a polymer, or the like, when the emulsion aggregation method described below is adopted.

As the volume-based median diameter falls within the foregoing range, half-tone image quality is improved by having improved transfer efficiency and image quality of a fine line, a dot or the like is also improved.

The volume-based median diameter of the toner particle is measured and calculated by using the measuring device "Multisizer 3" (manufactured by Beckman Coulter Inc.) connected to a computer system equipped with "Software V3.51", which is a software for data processing. Specifically, 0.02 g of the toner is added to a 20 ml surfactant solution (in which a neutral detergent containing a surfactant component is diluted 10 times with pure water for the purpose of dispersing toner particles) followed by fusion, and then subjected to ultrasonic dispersion for 1 minute to prepare the toner dispersion. The toner dispersion is introduced by a pipette into a beaker containing ISOTON II (manufactured by Beckman Coulter Inc.) placed in a sample stand until it reaches a display concentration of 8% by the measuring device. Such a concentration range makes it possible to obtain reproducible measurement values. Further, with regard to the measuring device, the counting number for measurement particles is set to 25000 particles and an aperture diameter of 50 μm are used. A measurement range of 1 to 30 μm is divided to 256 parts and the frequency of an individual part is calculated and the particle diameter at 50% of volume fraction integrated from the larger side is defined as the volume-based median diameter.

[Average Circularity of Toner Particle]

With regard to the toner of the present invention, the average circularity of each toner particle which constitutes the toner is preferably 0.930 to 1.000, from the viewpoint of improved transfer efficiency. More preferably, it is 0.950 to 0.995.

In the present invention, the average circularity of the toner particle is a value measured by using "FPIA-2100" (manufactured by Sysmex Corporation).

Specifically, a sample (toner particles) is fused in an aqueous solution added with a surfactant and dispersed for 1 minute by an ultrasonic dispersion treatment. By using "FPIA-2100" (manufactured by Sysmex Corporation), the measurement condition is set to HPF (high power imaging) mode and the image is taken at an optimum concentration including the HPF detection number of 3,000 to 10,000. The circularity is calculated for each toner particle according to the following formula (T), and the added circularity of each toner particle is divided by the total number of the toner particles.

Circularity=(Circumference length of a circle having the same projection area as a particle image)/(Circumference length of a projection image of a particle) Formula (T)

[Softening Point of Toner]

The softening point of the toner is preferably 80 to 120° C., and more preferably 90 to 110° C. from the viewpoint of providing the toner with low temperature fixability.

The softening point of the toner is measured by using a flow tester which will be described below.

Specifically, in an environment of 20° C.•50% RH, 1.1 g of a sample (toner) is first added to a petri dish, evenly spread, and kept at least for 12 hours. By using a molding machine "SSP-10A" (manufactured by Shimadzu Corporation), the sample is compressed for 30 seconds with a force of 3820 kg/cm$^2$ to produce a cylindrical molded sample with a diameter of 1 cm. Subsequently, the molded sample is extruded through holes (1 mm diameter×1 mm) of a cylindrical die by using a piston with a diameter of 1 cm at conditions including a load of 196 N (20 kgf), an initial temperature of 60° C., pre-heating time of 300 seconds, and a temperature increase rate of 6° C./minute in an environment of 24° C.•50% RH using a flow tester "CFT-500D" (manufactured by Shimadzu Corporation). The off-set method temperature $T_{offset}$, which is measured with a setting with off-set volume of 5 mm according to a melting temperature measuring method based on a temperature-increasing method, is a softening point.

[External Additives]

The toner particles described above can be used for forming a toner of the present invention as it is. However, from the viewpoint of improving the fluidity, electric charging characteristics, or cleaning property, the toner of the present invention may be formed by adding external additives such as a fluidizing agent as a so-called post-treatment agent or a cleaning aid to the toner particles.

Examples of the post-treatment agent include inorganic oxide microparticles such as silica microparticles, alumina microparticles or titanium oxide microparticle, inorganic stearic acid compound microparticles such as aluminum stearate microparticles or zinc stearate microparticles, and inorganic titanic acid compound microparticles such as strontium titanate or zinc titanate. These post-treatment agents may be used either singly or in combination of two or more types.

These inorganic microparticles are preferably those obtained by a surface treatment with a silane coupling agent, a titanium coupling agent, a higher fatty acid, a silicone oil or the like, for improving heat resistant storability and environmental stability.

The addition amount of the external additives is preferably 0.05 to 5 parts by mass, and more preferably 0.1 to 3 parts by mass in total relative to 100 parts by mass of the toner. Further, various kinds of those can be used in combination as external additives.

[Method for Manufacturing Toner]

The method for manufacturing a toner of the present invention is characterized in that, as a method for manufacturing the aforementioned toner, it includes of the step for aggregating and fusing microparticles including an amorphous resin for forming a binder resin and microparticles including an urethane modified crystalline resin for forming a binder resin, which is obtained by binding between a crystalline polymer segment and an urethane polymer segment and non-compatible with the amorphous resin, in which microparticles are dispersed in an aqueous medium and, as the urethane modified crystalline resin, a resin which has an ionic dissociating group amount of 5 to 20 mgKOH/g is used.

Specifically, it is preferred to use an emulsion aggregation method by which microparticles of a resin including a binder resin (the amorphous resin and the urethane modified crystalline resin) are aggregated and fused to yield the toner particles.

The emulsion aggregation method is a method for manufacturing toner particles in which a dispersion of microparticles of a resin constituting the binder resin is admixed with, as necessary, a dispersion of a microparticles of other components constituting the toner particles and slowly aggregated while maintaining a balance between repulsive force on a surface of microparticles caused by pH control and aggregation force caused by adding an aggregating agent including an electrolytic material, and by performing fusion among microparticles simultaneously with association with the control of average particle diameter and particle size distribution, shape control is performed under heating and stirring.

A specific example of the method for manufacturing a toner is as follows.

The toner is manufactured through:

(1) A step for preparing a dispersion of colorant microparticles by dispersing a colorant in an aqueous medium to prepare a dispersion of colorant microparticles (2) A step for preparing a dispersion of urethane modified crystalline resin microparticles in which the urethane modified crystalline resin is dispersed in an aqueous medium to prepare a dispersion of urethane modified crystalline resin microparticles (3) A step for preparing a dispersion of amorphous resin microparticles in which the amorphous resin containing a releasing agent, and as necessary, components constituting toner particles like a charge controlling agent are contained is dispersed in an aqueous medium to prepare a dispersion of amorphous resin microparticles (4) A step for aggregating and fusion in which amorphous resin microparticles, urethane modified crystalline resin microparticles, and colorant microparticles are aggregated and fused in an aqueous medium to form aggregated particles (5) A step for aging in which a dispersion of toner particles is produced by performing shape control based on aging of aggregated particles with heat energy (6) A step for cooling in which a dispersion of toner particles is cooled (7) A step for filtering and washing in which toner particles are separated by solid liquid separation from a cooled dispersion of toner particles and removing a surfactant or the like from a surface of toner particles, and (8) A step for drying in which the toner particles obtained after the washing treatment are dried, and as necessary, the following step can be added, (9) A step for adding external additives in which external additives are added to the toner particles obtained after the drying treatment.

The "aqueous medium" described in the present invention indicates a medium which includes 50 to 100% by mass of water and 0 to 50% by mass of a water-soluble organic solvent. Examples of the water-soluble organic solvent include methanol, ethanol, isopropanol, butanol, acetone, methyl ethyl ketone, and tetrahydrofuran. An alcoholic organic solvent not dissolving a resin to be obtained is preferably used.

(1) Step for Preparing Dispersion of Colorant Microparticles

A dispersion of colorant microparticles can be prepared by dispersing a colorant in an aqueous medium. From the viewpoint of homogeneous dispersion of a colorant, the treatment for dispersing a colorant is preferably performed in a state in which the concentration of a surfactant in an aqueous medium is equal to or higher than the critical micelle concentration (CMC). As a disperser used for a dispersing treatment of a colorant, various well-known dispersers can be used.

[Surfactant]

Examples of the surfactant include an anionic surfactant such as alkyl sulfuric acid ester salt, polyoxyethylene(n)alkyl ether sulfate, alkylbenzene sulfonate, -olefin sulfonate, or phosphoric acid ester, a cationic surfactant including an amine type such as alkylamine salt, aminoalcohol fatty acid derivative, polyamine fatty acid derivative, or imidazoline and quaternary ammonium type such as alkyltrimethyl ammonium salt, dialkyldimethyl ammonium salt, alkyldimethylbenzyl ammonium salt, pyridinium salt, alkylisoquinolinium salt, or benzethonium chloride, a non-ionic surfactant such as fatty acid amide derivative or polyhydric alcohol derivative, and amphoteric surfactant such as alanine, dodecyl di(aminoethyl)glycine, di(octylaminoethyl)glycine, or N-alkyl-N,N-dimethylammonium betaine. Further, an anionic surfactant or a cationic surfactant having a fluoroalkyl group can be also used.

The dispersion diameter of colorant microparticles in a dispersion of colorant microparticles which are prepared by the step for preparing a dispersion of colorant microparticles is, in terms of a volume-based median diameter, preferably in the range of 10 to 300 nm.

The volume-based median diameter of the colorant microparticle in a dispersion of colorant microparticles is measured by using an electrophoretic light scattering photometer "ELS-800" (manufactured by Otsuka Electronics Co., Ltd.).

The colorant can be also introduced to the toner particles by dissolving or dispersing it in advance in a monomer solution for forming the amorphous resin by using a mini-emulsion method for the step for preparing a dispersion of amorphous resin microparticles described below.

(2) Step for Preparing Dispersion of Urethane Modified Crystalline Resin Microparticles Examples of the method for dispersing the urethane modified crystalline resin in an aqueous medium include a method in which an aqueous medium (aqueous phase) containing a surfactant is prepared simultaneously with preparation of an oil phase liquid by dissolving or dispersing the urethane modified crystalline resin in an organic solvent, the oil phase liquid is added to the aqueous phase in a state in which an inorganic alkali compound or an organic alkali compound is added to the oil phase liquid or aqueous phase, oil droplets are formed by emulsification based on application of mechanical shear force like high speed stirring and ultrasonication or the like, and the organic solvent is removed.

Further, a so-called phase inversion emulsification for adding an aqueous phase to the oil phase liquid may be also used.

The use amount of the aqueous medium is preferably 50 to 2,000 parts by mass relative to 100 parts by mass of the oil phase liquid.

As the use amount of the aqueous medium is within the aforementioned range, the oil phase liquid can be emulsified and dispersed to a desired particle diameter in the aqueous medium.

The surfactant to be used is the same as those surfactants described above, for example.

As for the organic solvent which is used for preparing the oil phase liquid, those having a low boiling point and also low water solubility are preferable from the viewpoint of having easy removal after forming oil droplets. Specific examples thereof include methyl acetate, ethyl acetate, methyl ethyl ketone, methyl isobutyl ketone, toluene, and xylene. It may be used either singly or in combination of two or more types.

The use amount of the organic solvent is generally 1 to 300 parts by mass, preferably 1 to 100 parts by mass, and more preferably 25 to 70 parts by mass relative to 100 parts by mass of the urethane modified crystalline resin.

Removal of the organic solvent after forming oil droplets can be performed by an operation including gradually increasing, in a stirring state with laminar flow, the temperature of an entire dispersion in a state in which toner particles are dispersed in an aqueous medium, performing strong stirring in a constant temperature range, and removing the solvent or the like.

The average particle diameter of the urethane modified crystalline resin microparticles, which are obtained by a step for preparing a dispersion of urethane modified crystalline resin microparticles, is preferably in the range of 50 to 500 nm in terms of a volume-based median diameter.

Meanwhile, the volume-based median diameter is measured by using "UPA-150" (manufactured by Microtrac).

(3) Step for Preparing Dispersion of Amorphous Resin Microparticles

When the amorphous resin is a styrene acrylic resin, a dispersion of amorphous resin microparticles can be prepared as follows: a polymerizable monomer for forming a styrene acrylic resin, which becomes the amorphous resin, is added in an aqueous medium containing a surfactant at a concentration equal to or higher than critical micelle concentration (CMC), and then a water-soluble polymerization initiator is added at a desired polymerization temperature under stirring to perform the polymerization.

Meanwhile, similarly, when the amorphous resin is a styrene acrylic resin, it is also possible that a dispersion of amorphous resin microparticles is obtained as follows: a monomer solution in which a polymerizable monomer for forming a styrene acrylic resin, which becomes the amorphous resin, and as necessary, components constituting the toner like a releasing agent and a charge controlling agent are dissolved or dispersed is added in an aqueous medium containing a surfactant at a concentration equal to or lower than critical micelle concentration (CMC), liquid droplets are formed by applying mechanical energy, and subsequently a polymerization reaction in the liquid droplets is performed by adding a water soluble radical polymerization initiator. Meanwhile, an oil soluble polymerization initiator may be contained in the liquid droplets. In the step for preparing a dispersion of amorphous resin microparticles, an emulsifying treatment (forming liquid droplets) by applying mechanical energy mandatorily is essential. As an applying unit such mechanical energy, an applying unit for applying strong stirring or ultrasonic vibration energy like a homomixer, an ultrasonicator, and Manton Gaulin can be mentioned.

The amorphous resin microparticles which are formed by the step for preparing a dispersion of amorphous resin microparticles may have a constitution with two or more layers including a resin with different composition. In that case, a method in which a polymerization initiator and a polymerizable monomer are added to a dispersion of the first resin particles that are prepared according to a common emulsion polymerization treatment (first stage polymerization) and then the system is subjected to a polymerization treatment (second stage polymerization) can be adopted.

When a surfactant is used for the above step, the surfactant which is the same as those surfactants described above can be used.

[Polymerization Initiator]

As for the polymerization initiator to be used, various well-known polymerization initiators can be used. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropylperoxycarbonate, tetralin hydroperoxide, 1-phenyl-2-methylpropyl-1-hydroperoxide, per-triphenylacetic acid-tert-hydroperoxide, tert-butyl performate, tert-butyl peracetate, tert-butyl perbenzoate, tert-butyl perphenylacetic acid, tert-butyl permethoxyacetic acid, or tert-butyl N-(3-toluoyl)palmitic acid; and azo compounds such as 2,2'-azobis(2-aminodipropane)hydrochloride, 2,2'-azobis-(2-aminodipropane) nitrate, 1,1'-azobis(sodium 1-methylbutyronitrile-3-sulfonate), 4,4'-azobis-4-cyanovaleric acid, or poly(tetraethylene-glycol-2,2'-azobisisobutylate). Among them, a water soluble polymerization initiator, for example, ammonium persulfate, sodium persulfate, potassium persulfate, hydrogen peroxide, 2,2'-azobis(2-aminodipropane)hydrochloride, 2,2'-azobis-(2-aminodipropane) nitrate, 1,1'-azobis(sodium 1-methylbutyronitrile-3-sulfonate), and 4,4'-azobis-4-cyanovaleric acid can be preferably used. Further, a redox polymerization initiator like persulfate and metabisulfite, hydrogen peroxide and ascorbic acid can be also used as a polymerization initiator.

[Chain Transfer Agent]

For the step for preparing a dispersion of amorphous resin microparticles, a commonly used chain transfer agent can be used for the purpose of controlling the molecular weight of the amorphous resin. The chain transfer agent is not particularly limited, and examples thereof include alkyl mercaptan and mercapto fatty acid ester, or the like.

The average particle diameter of the amorphous resin microparticles, which are obtained by the step for preparing a dispersion of amorphous resin microparticles, is preferably in the range of 50 to 500 nm in terms of a volume-based median diameter.

Meanwhile, the volume-based median diameter is measured by using "UPA-150" (manufactured by Microtrac).

(4) Step for Aggregation and Fusion

This step is for aggregating and fusing, in an aqueous medium, colorant microparticles, amorphous resin microparticles, and urethane modified crystalline resin microparticles which are formed by the step described above. According to this step, a dispersion of amorphous resin microparticles, a dispersion of urethane modified crystalline resin microparticles, and a dispersion of colorant microparticles are added to an aqueous medium and those microparticles are aggregated and fused therein.

The specific method for aggregating and fusing the colorant microparticles, amorphous resin microparticles, and urethane modified crystalline resin microparticles is as follows: an aggregating agent is added to an aqueous medium such that it has a concentration equal to or higher than the critical aggregation concentration, salting-out of the microparticles like the colorant microparticles, amorphous resin microparticles, and urethane modified crystalline resin microparticles is performed simultaneously with fusion by heating at a temperature which is equal to or higher than a glass transition point of the amorphous resin microparticles but equal to or higher than a melt peak temperature of a releasing agent and the urethane modified crystalline resin, particle growth is terminated by adding an aggregation terminator when the growth is progressed to the desired particle diameter, and also, as necessary, heating is further continued to control the particle shape.

In this method, it is preferable that the time for keeping after addition of an aggregating agent be as short as possible and the heating is quickly performed at a temperature which is equal to or higher than the glass transition point of the amorphous resin microparticles which is related to the binder resin. This is because, although the reason is not entirely clear, there is a concern regarding an occurrence of problems like unstable particle diameter distribution due to a change in an aggregation state of particle, or a change in surface property of the fused particles in accordance with the keeping time after salting-out. Time period until the temperature increase is preferably 30 minutes or shorter, and more preferably 10 minutes or shorter. Further, the temperature increase rate is 1° C./minute or more. Although the upper limit of the temperature increase rate is not particularly limited, from the viewpoint of suppressing an occurrence of coarse particles caused by rapid progress of fusion, it is preferably 15° C./minute or less. After the reaction system reaches a temperature which is equal to or higher than the glass transition point, it is important to continue the fusion by maintaining the temperature of the reaction system for a certain period of time. Accordingly, it is possible to have effective progress of the toner particle growth and fusion, and thus the durability of the toner particles that are finally obtained can be improved.

[Aggregating Agent]

An aggregating agent which may be used is not particularly limited but one selected from metal salts is preferably used. Examples of the metal salts include a salt of a monovalent metal such as alkali metal such as sodium, potassium or lithium; a salt of a divalent metal such as calcium, magnesium, manganese or copper; and a salt of a trivalent metal such as iron or aluminum. Specific examples of the metal salts may include sodium chloride, potassium chloride, lithium chloride, calcium chloride, magnesium chloride, zinc chloride, copper sulfate, magnesium sulfate and manganese sulfate. Of these salts, a divalent metal salt is particularly preferably used from the viewpoint that the aggregation can be achieved by use of a smaller amount. It may be used either singly or in combination of two or more types.

When a surfactant is used for the above step, the surfactant which is the same as those surfactants described above can be used, for example.

(5) Aging Step

This step is a step for forming toner particles with a desired shape by heating and stirring a system containing the aggregated particles and controlling the heating temperature, stirring speed, or heating time until the aggregated particles can have a shape with desired average circularity. For this step, the shape control of the toner particles is preferably carried out by using thermal energy (heating).

(6) Cooling Step to (8) Drying Step

The cooling step, filtering and washing step, and drying step can be performed by adopting various well-known methods.

(9) Step for Treating with External Additives

The step for treating with external additives is a step for adding and mixing, as necessary, external additives in the toner particles obtained after the drying treatment.

Examples of the method for adding the external additives include a dry process in which external additives in a powdery form are added to dried toner particles and examples of a mixing device include a mechanical mixing device such as a Henschel mixer or a coffee mill.

The toner can be manufactured by following the aforementioned method for manufacturing a toner.

[Developer]

The toner of the present invention is usable as a magnetic or non-magnetic one-component developer. However, it is also usable as a two-component developer after mixing with a carrier.

As for the carrier, magnetic particles including well-known materials in the past, for example, a metal such as iron, ferrite or magnetite, an alloy of the foregoing metal and a metal of aluminum or lead can be used. Of these, ferrite particles are preferably used. Further, there may be used as a carrier a coated carrier in which the surfaces of magnetic particles are coated with a coating agent such as a resin or a resin dispersion type carrier in which a fine powdery magnetic material is dispersed in a binder resin.

As for the carrier, those having a volume average particle diameter of 15 to 100 μm are preferable, and those with 25 to 80 μm are more preferable.

[Image Forming Apparatus]

The toner of the present invention can be used for forming an image by a general electrophotographic method. Examples of an image forming apparatus which may be used for performing such image forming method include those including a photoreceptor as a carrier for an electrostatic latent image, a charging unit for applying even potential on a surface of the photoreceptor by corona discharge having the same polarity as the toner, an exposure unit for forming an electrostatic latent image on a surface of evenly charged photoreceptor by performing image exposure based on image data, a development unit for forming a toner image by transferring the toner to a surface of the photoreceptor to develop the electrostatic latent image, a transfer unit for transferring the toner image to a transfer medium via an intermediate transfer medium, as necessary, and a fixing unit for heating and fixing the toner image on the transfer medium.

Furthermore, the toner of the present invention can be preferably used at a relatively low temperature at which the fixing temperature (surface temperature of a fixing member) is 100 to 200° C.

The embodiments of the present invention are specifically described in the above. However, the embodiments of the present invention are not limited to the above examples, and it is possible to have various modifications.

EXAMPLES

Hereinbelow, the present invention will be described specifically with reference to examples, but the present invention is not limited to them.

Synthetic Example of Crystalline Polyester Diol [1]

To a reaction vessel equipped with a condenser tube, a stirrer, an inlet tube for nitrogen, and a pressure reducing device, 691 parts by mass of sebacic acid: dicarboxylic acid component, 430 parts by mass of 1,6-hexane diol:diol component, and 2 parts by mass of tetrabutoxy titanate were added. After increasing the temperature to 180° C., the reaction was allowed to occur for 10 hours under nitrogen stream at the same temperature while distilling off the water generated. Subsequently, the temperature was slowly increased to 220° C., and the reaction was allowed to occur for 5 hours under nitrogen stream while distilling off water. The reaction was further allowed to occur under reduced pressure of 0.007 mmHg to 0.0026 MPa while distilling off water. By collecting the product when the acid value is 0.1 mgKOH/g, the crystalline polyester diol [1] was obtained.

The weight average molecular weight (Mw) of the crystalline polyester diol [1] was 8,000 and the melting point was 67° C.

Synthetic Examples of Crystalline Polyester Diols [2] to [6]

The crystalline polyester diols [2] to [6] were obtained in the same manner as the synthetic example of the crystalline polyester diol [1] except that the formulation of the following Table 1 was followed.

TABLE 1

| Crystalline polyester diol No. | Polyhydric alcohol Compound | Polyhydric alcohol Addition amount (parts by mass) | Polyhydric carboxylic acid Compound | Polyhydric carboxylic acid Addition amount (parts by mass) | Mw | Melting point (° C.) |
|---|---|---|---|---|---|---|
| [1] | 1,6-Hexane diol | 430 | Sebacic acid | 691 | 8000 | 67 |
| [2] | Ethylene glycol | 226 | Sebacic acid | 691 | 8200 | 71 |
| [3] | 1,4-Butane diol | 328 | Sebacic acid | 691 | 8600 | 66 |
| [4] | 1,6-Hexane diol | 430 | Adipic acid | 499 | 7600 | 55 |
| [5] | 1,9-Nonane diol | 583 | Dodecanedioic acid | 787 | 7800 | 73 |
| [6] | 1,10-Decane diol | 583 | Dodecanedioic acid | 634 | 8300 | 84 |

Synthetic Examples of Urethane Modified Crystalline Resin [a]

To a reaction vessel equipped with a condenser tube, a stirrer, a thermometer, and an inlet tube for nitrogen, 500 parts by mass of dehydrated methyl ethyl ketone and 486 parts by mass of the crystalline polyester diol [1] were added. By performing stirring for 1 hour at 300 rpm at 60° C. under nitrogen stream for dissolving them, 14 parts by mass of 1,6-hexamethylene diisocyanate were added and the reaction was allowed to occur for 10 hours at 80° C. Further, methyl ethyl ketone was removed by distillation and the resultant was collected as the urethane modified crystalline resin [a].

The number average molecular weight (Mn) of the urethane modified crystalline resin [a] was 18,000 and the weight average molecular weight (Mw) was 35,000. Further, the amount of ionic dissociating group was 0 mgKOH/g, the melting point was 66° C., and the endothermic amount (ΔH0) was 75 J/g.

Synthetic Example of Urethane Modified Crystalline Resin [A1] Given with Ionic Dissociating Group To a reaction vessel equipped with a condenser tube, a stirrer, a thermometer, a pressure reducing device, and an inlet tube for nitrogen, 500 parts by mass of dehydrated methyl ethyl ketone and 486 parts by mass of the crystalline polyester diol [1] were added. By performing stirring for 1 hour at 300 rpm at 60° C. under nitrogen stream for dissolving them, 14 parts by mass of 1,6-hexamethylene diisocyanate were added and the reaction was allowed to occur for 10 hours at 80° C. Then, 8 parts by mass of trimellitic anhydride and 0.5 parts by mass of tetrabutoxy titanate as a catalyst were added. The temperature was increased to 120° C. and the reaction was allowed to occur for 5 hours. Thereafter, methyl ethyl ketone was removed by distillation to obtain the urethane modified crystalline resin [A1] given with an ionic dissociating group.

The number average molecular weight (Mn) of the urethane modified crystalline resin [A1] given with an ionic dissociating group was 18,000 and the weight average molecular weight (Mw) was 35,000. Further, the amount of ionic dissociating group was 10 mgKOH/g, the melting point was 67° C., and the endothermic amount (ΔH0) was 74 J/g.

Synthetic Example of Urethane Modified Crystalline Resin [A2] Given with Ionic Dissociating Group To a reaction vessel equipped with a condenser tube, a stirrer, a thermometer, and an inlet tube for nitrogen, 500 parts by mass of dehydrated methyl ethyl ketone, 452 parts by mass of the crystalline polyester diol [1], and 18 parts by mass of dimethylol propionic acid were added. Stirring was performed for 1 hour at 450 rpm at 60° C. under nitrogen stream for dissolving them. Subsequently, 33 parts by mass of 1,6-hexamethylene diisocyanate were added to the solution and the reaction was allowed to occur for 12 hours at 80° C. Thereafter, methyl ethyl ketone was removed by distillation to obtain the urethane modified crystalline resin [A2] given with an ionic dissociating group.

The number average molecular weight (Mn) of the urethane modified crystalline resin [A2] given with an ionic dissociating group was 18,500 and the weight average molecular weight (Mw) was 52,000. Further, the amount of ionic dissociating group was 16 mgKOH/g, the melting point was 65° C., and the endothermic amount (ΔH0) was 70 J/g.

Synthetic Example of Urethane Modified Crystalline Resin [A3] Given with Ionic Dissociating Group To a reaction vessel equipped with a condenser tube, a stirrer, a thermometer, a pressure reducing device, and an inlet tube for nitrogen, 500 parts by mass of dehydrated methyl ethyl ketone, 452 parts by mass of the crystalline polyester diol [1], and 7 parts by mass of dimethylol propionic acid were added. Stirring was performed for 1 hour at 450 rpm at 60° C. under nitrogen stream for dissolving them. Subsequently, 33 parts by mass of 1,6-hexamethylene diisocyanate were added to the solution and the reaction was allowed to occur for 12 hours at 80° C. Then, 8 parts by mass of trimellitic anhydride and 0.5 parts by mass of tetrabutoxy titanate as a catalyst were added. The temperature was increased to 120° C. and the reaction was allowed to occur for 5 hours. Thereafter, methyl ethyl ketone was removed by distillation to obtain the urethane modified crystalline resin [A3] given with an ionic dissociating group.

The number average molecular weight (Mn) of the urethane modified crystalline resin [A3] given with an ionic dissociating group was 20,000 and the weight average molecular weight (Mw) was 53,000. Further, the amount of ionic dissociating group was 20 mgKOH/g, the melting point was 66° C., and the endothermic amount (ΔH0) was 69 J/g.

Synthetic Example of Urethane Modified Crystalline Resin [A4] Given with Ionic Dissociating Group The urethane modified crystalline resin [A4] given with an ionic dissociating group was obtained in the same manner as the synthetic example of the urethane modified crystalline resin [A3] given with an ionic dissociating group except that the crystalline polyester diol [2] was used instead of the crystalline polyester diol [1].

The number average molecular weight (Mn) of the urethane modified crystalline resin [A4] given with an ionic dissociating group was 17,000 and the weight average molecular weight (Mw) was 53,000. Further, the amount of ionic dissociating group was 18 mgKOH/g, the melting point was 68° C., and the endothermic amount (ΔH0) was 50 J/g.

Synthetic Example of Urethane Modified Crystalline Resin [A5] Given with Ionic Dissociating Group To a reaction vessel equipped with a condenser tube, a stirrer, a thermometer, a pressure reducing device, and an inlet tube for nitrogen, 500 parts by mass of dehydrated methyl ethyl ketone, 455 parts by mass of the crystalline polyester diol [3], and 8 parts by mass of dimethylol propionic acid were added. Stirring for 1 hour at 450 rpm at 60° C. under nitrogen stream was performed for uniformly dissolving them. Further, 33 parts by mass of 1,6-hexamethylene diisocyanate were added to the solution and the reaction was allowed to occur for 10 hours at 80° C. Then, 4 parts by mass of trimellitic anhydride and 0.5 parts by mass of tetrabutoxy titanate as a catalyst were added. The internal temperature was increased to 120° C. and the reaction was allowed to occur for 5 hours. Thereafter, methyl ethyl ketone was removed by distillation to obtain the urethane modified crystalline resin [A5] given with an ionic dissociating group.

The number average molecular weight (Mn) of the urethane modified crystalline resin [A5] given with an ionic dissociating group was 22,000 and the weight average molecular weight (Mw) was 49,000. Further, the amount of ionic dissociating group was 11 mgKOH/g, the melting point was 67° C., and the endothermic amount (ΔH0) was 62 J/g.

Synthetic Example of Urethane Modified Crystalline Resin [A6] Given with Ionic Dissociating Group To a reaction vessel equipped with a condenser tube, a stirrer, a thermometer, a pressure reducing device, and an inlet tube for nitrogen, 500 parts by mass of dehydrated methyl ethyl ketone, 454 parts by mass of the crystalline polyester diol [4], and 5 parts by mass of dimethylol propionic acid were added. Stirring was performed for 1 hour at 450 rpm at 60° C. under nitrogen stream for dissolving them. Further, 33 parts by mass of 1,6-hexamethylene diisocyanate were added to the solution and the reaction was allowed to occur for 8 hours at 80° C. Then, 8 parts by mass of trimellitic anhydride and 0.5 parts by mass of tetrabutoxy titanate as a catalyst were added. The internal temperature was increased to 120° C. and the reaction was allowed to occur for 8 hours. Thereafter, methyl ethyl ketone was removed by distillation to obtain the urethane modified crystalline resin [A6] given with an ionic dissociating group.

The number average molecular weight (Mn) of the urethane modified crystalline resin [A6] given with an ionic dissociating group was 22,000 and the weight average molecular weight (Mw) was 48,000. Further, the amount of ionic dissociating group was 11 mgKOH/g, the melting point was 53° C., and the endothermic amount (ΔH0) was 58 J/g.

Synthetic Example of Urethane Modified Crystalline Resin [A7] Given with Ionic Dissociating Group To a reaction vessel equipped with a condenser tube, a stirrer, a thermometer, a pressure reducing device, and an inlet tube for nitrogen, 500 parts by mass of dehydrated methyl ethyl ketone, 454 parts by mass of the crystalline polyester diol [5], and 6 parts by mass of dimethylol propionic acid were added. Stirring was performed for 1 hour at 450 rpm at 60° C. under nitrogen stream for dissolving them. Further, 33 parts by mass of 1,6-hexamethylene diisocyanate were added to the solution and the reaction was allowed to occur for 8 hours at 80° C. Then, 7 parts by mass of trimellitic anhydride and 0.5 parts by mass of tetrabutoxy titanate as a catalyst were added. The internal temperature was increased to 120° C. and the reaction was allowed to occur for 8 hours. Thereafter, methyl ethyl ketone was removed by distillation to obtain the urethane modified crystalline resin [A7] given with an ionic dissociating group.

The number average molecular weight (Mn) of the urethane modified crystalline resin [A7] given with an ionic dissociating group was 21,000 and the weight average molecular weight (Mw) was 47,000. Further, the amount of ionic dissociating group was 13 mgKOH/g, the melting point was 72° C., and the endothermic amount (ΔH0) was 87 J/g.

Synthetic Example of Urethane Modified Crystalline Resin [A8] Given with Ionic Dissociating Group To a reaction vessel equipped with a condenser tube, a stirrer, a thermometer, a pressure reducing device, and an inlet tube for nitrogen, 500 parts by mass of dehydrated methyl ethyl ketone, 455 parts by mass of the crystalline polyester diol [5], and 6 parts by mass of dimethylol propionic acid were added. Stirring was performed for 1 hour at 450 rpm at 60° C. under nitrogen stream for dissolving them. Further, 33 parts by mass of 1,6-hexamethylene diisocyanate were added to the solution and the reaction was allowed to occur for 8 hours at 80° C. Then, 6 parts by mass of trimellitic anhydride and 0.5 parts by mass of tetrabutoxy titanate as a catalyst were added. The internal temperature was increased to 120° C. and the reaction was allowed to occur for 8 hours. Thereafter, methyl ethyl ketone was removed by distillation to obtain the urethane modified crystalline resin [A8] given with an ionic dissociating group.

The number average molecular weight (Mn) of the urethane modified crystalline resin [A8] given with an ionic dissociating group was 19,000 and the weight average molecular weight (Mw) was 46,000. Further, the amount of ionic dissociating group was 12 mgKOH/g, the melting point was 67° C., and the endothermic amount (ΔH0) was 82 J/g.

Synthetic Example of Urethane Modified Crystalline Resin [A9] Given with Ionic Dissociating Group To a reaction vessel equipped with a condenser tube, a stirrer, a thermometer, a pressure reducing device, and an inlet tube for nitrogen, 478 parts by mass of the urethane modified crystalline resin [a] and 500 parts by mass of dehydrated methyl ethyl ketone were added. By performing stirring at 60° C. under nitrogen stream, a homogenous solution was obtained. After further adding 13 parts by mass of 1,6-hexamethylene diisocyanate, the reaction was allowed to occur for 10 hours at 80° C. Then, 9 parts by mass of sulfonated benzoic acid and 0.5 parts by mass of tetrabutoxy titanate as a catalyst were added. The internal temperature was increased to 120° C. and the reaction was allowed to occur for 8 hours. Thereafter, methyl ethyl ketone was removed by distillation to obtain the urethane modified crystalline resin [A9] given with an ionic dissociating group.

The number average molecular weight (Mn) of the urethane modified crystalline resin [A9] given with an ionic dissociating group was 18,000 and the weight average molecular weight (Mw) was 35,000. Further, the amount of ionic dissociating group was 6 mgKOH/g, the melting point was 67° C., and the endothermic amount (ΔH0) was 70 J/g.

Synthetic Example of Urethane Modified Crystalline Resin [A10] Given with Ionic Dissociating Group To a reaction vessel equipped with a condenser tube, a stirrer, a thermometer, a pressure reducing device, and an inlet tube for nitrogen, 448 parts by mass of the crystalline polyester diol [1], 500 parts by mass of dehydrated methyl ethyl ketone, 33 parts by mass of 1,6-hexamethylene diisocyanate, and 10 parts by mass of dihydroxymethane sulfonic acid were added. By performing stirring at 450 rpm and 60° C. under nitrogen stream, a homogenous solution was obtained. After further adding 33 parts by mass of 1,6-hexamethylene diisocyanate, the reaction was allowed to occur for 10 hours at 80° C. Then, 9 parts by mass of sulfonated benzoic acid and 0.5 parts by mass of tetrabutoxy titanate were added. The internal temperature was further increased to 120° C. and the reaction was allowed to occur for 8 hours. Thereafter, methyl ethyl ketone was removed by distillation to obtain the urethane modified crystalline resin [A10] given with an ionic dissociating group.

The number average molecular weight (Mn) of the urethane modified crystalline resin [A10] given with an ionic dissociating group was 18,000 and the weight average molecular weight (Mw) was 35,000. Further, the amount of ionic dissociating group was 12 mgKOH/g, the melting point was 66° C., and the endothermic amount (ΔH0) was 70 J/g.

Synthetic Example of Urethane Modified Crystalline Resin [A11] Given with Ionic Dissociating Group To a reaction vessel equipped with a condenser tube, a stirrer, a thermometer, a pressure reducing device, and an inlet tube for nitrogen, 482 parts by mass of the urethane modified crystalline resin [a] and 500 parts by mass of dehydrated methyl ethyl ketone were added. By performing stirring at 60° C. under nitrogen stream, a homogenous solution was obtained. After further adding 13 parts by mass of 1,6-hexamethylene diisocyanate, the reaction was allowed to occur for 10 hours at 80° C. Then, 5 parts by mass of succinic acid and 0.5 parts by mass of tetrabutoxy titanate were added followed by stirring under nitrogen stream to obtain a homogeneous solution. The internal temperature was further increased to 120° C. and the reaction was allowed to occur for 8 hours. Thereafter, methyl ethyl ketone was removed by distillation to obtain the urethane modified crystalline resin [A11] given with an ionic dissociating group.

The number average molecular weight (Mn) of the urethane modified crystalline resin [A11] given with an ionic dissociating group was 18,000 and the weight average molecular weight (Mw) was 35,000. Further, the amount of ionic dissociating group was 4 mgKOH/g, the melting point was 63° C., and the endothermic amount (ΔH0) was 60 J/g.

Synthetic Example of Urethane Modified Crystalline Resin [A12] Given with Ionic Dissociating Group To a reaction vessel equipped with a condenser tube, a stirrer, a thermometer, a pressure reducing device, and an inlet tube for nitrogen, 500 parts by mass of dehydrated methyl ethyl ketone, 445 parts by mass of the crystalline polyester diol [6], and 12 parts by mass of dimethylol propionic acid were added. By performing stirring at 450 rpm and 60° C. under nitrogen stream, a homogenous solution was obtained. After further adding 33 parts by mass of 1,6-hexamethylene diisocyanate, the reaction was allowed to occur for 10 hours at 80° C. Then, 10 parts by mass of trimellitic anhydride and 0.5 parts by mass of tetrabutoxy titanate were added. The internal temperature was increased to 120° C. and the reaction was allowed to occur for 5 hours. Thereafter, purification was performed by cooling and re-precipitation of the resin. The resultant was obtained as the urethane modified crystalline resin [A12] given with an ionic dissociating group.

The number average molecular weight (Mn) of the urethane modified crystalline resin [A12] given with an ionic dissociating group was 22,000 and the weight average molecular weight (Mw) was 53,000. Further, the amount of ionic dissociating group was 21 mgKOH/g, the melting point was 71° C., and the endothermic amount (ΔH0) was 79 J/g.

Preparation Example of Dispersion of Urethane Modified Crystalline Resin Microparticles [A1] Given with Ionic Dissociating Group To 400 parts by mass of methyl ethyl ketone, 100 parts by mass of the urethane modified crystalline resin [A1] given with an ionic dissociating group were added and dissolved therein by heating at 65° C. under stirring. Further, 1.8 parts by mass of triethylamine were added for performing neutralization, and thus an oil phase was prepared.

Meanwhile, by dissolving 1 part by mass of sodium dodecyl sulfate in 900 parts by mass of de-ionized water, an aqueous phase was obtained.

The oil phase was slowly added to the aqueous phase under stirring followed by high speed stirring. The particle diameter was measured by determining the obtained emulsion using a laser type particle size distribution analyzer "LA-920" (manufactured by HORIBA, Ltd.). The high speed stirring was terminated at a time point at which the particle diameter does not change. After that, by removing methyl ethyl ketone from the emulsion under reduced pressure, a dispersion of urethane modified crystalline resin microparticles [A1] given with an ionic dissociating group was prepared.

The average particle diameter of the microparticles in the dispersion of urethane modified crystalline resin microparticles [A1] given with an ionic dissociating group was 180 nm.

Preparation Examples of Dispersions of Urethane Modified Crystalline Resin Microparticles [A2] to [A12] Given with Ionic Dissociating Group The dispersions of urethane modified crystalline resin microparticles [A2] to [A12] given with an ionic dissociating group were obtained in the same manner as the preparation example of dispersion of urethane modified crystalline resin microparticles [A1] given with an ionic dissociating group except that the formulation of the following Table 2 was followed and also triethylamine was used in the same molar amount as the amount of the ionic dissociating group in the urethane modified crystalline resin given with an ionic dissociating group.

Preparation Example of Dispersion of Urethane Modified Crystalline Resin Microparticles [a]

The dispersion of urethane modified crystalline resin microparticles [a] was obtained in the same manner as the preparation example of dispersion of urethane modified crystalline resin microparticles [A1] given with an ionic dissociating group except that the formulation of the following Table 2 was followed and also triethylamine was not used.

TABLE 2

| Dispersion No. | Resin | Amount of ionic dissociating group (mgKOH/g) | Average particle diameter (nm) | State |
|---|---|---|---|---|
| [A1] | Urethane modified crystalline resin [A1] given with ionic dissociating group | 10 | 180 | Stable |
| [A2] | Urethane modified crystalline resin [A2] given with ionic dissociating group | 16 | 100 | Stable |
| [A3] | Urethane modified crystalline resin [A3] given with ionic dissociating group | 20 | 75 | Stable |
| [A4] | Urethane modified crystalline resin [A4] given with ionic dissociating group | 18 | 85 | Stable |
| [A5] | Urethane modified crystalline resin [A5] given with ionic dissociating group | 11 | 125 | Stable |
| [A6] | Urethane modified crystalline resin [A6] given with ionic dissociating group | 11 | 125 | Stable |
| [A7] | Urethane modified crystalline resin [A7] given with ionic dissociating group | 13 | 110 | Stable |
| [A8] | Urethane modified crystalline resin [A8] given with ionic dissociating group | 12 | 120 | Stable |
| [A9] | Urethane modified crystalline resin [A9] given with ionic dissociating group | 6 | 170 | Stable |
| [A10] | Urethane modified crystalline resin [A10] given with ionic dissociating group | 12 | 100 | Stable |
| [A11] | Urethane modified crystalline resin [A11] given with ionic dissociating group | 4 | — | Cannot be emulsified |
| [A12] | Urethane modified crystalline resin [A12] given with ionic dissociating group | 21 | 20 or less | Almost dissolved state |
| [a] | Urethane modified crystalline resin [a] | 0 | — | Cannot be emulsified |

As described above, when the urethane modified crystalline resins [A1] to [A10] given with an ionic dissociating group of which the amount of ionic dissociating group is in the range of 5 to 20 mgKOH/g are used, it was found that a stable dispersion can be prepared. Meanwhile, when the urethane modified crystalline resin [A11] given with an ionic dissociating group of which the amount of ionic dissociating group is excessively low or the urethane modified crystalline resin [a] of which the amount of ionic dissociating group is zero is used, the microparticles precipitated after the high speed stirring so that an emulsified state cannot be obtained even after removing the solvent. Further, in the case of using the urethane modified crystalline resin [A12] given with an ionic dissociating group of which the amount of ionic dissociating group is excessively high, a transparent solution was yielded during the step for performing high speed stirring so that the average particle diameter was 20 nm or less even after removing the solvent.

Preparation Example of Dispersion of Amorphous Resin Microparticles [B1]

By mixing 140 parts by mass of styrene, 50 parts by mass of n-butyl acrylate, 10 parts by mass of methacrylic acid, and 30 parts by mass of pentaerythritol tetrabehenate (melting point: 82° C.) and dissolving them while maintaining the temperature at 85° C., a monomer solution was obtained.

Meanwhile, 870 parts by mass of 0.5% aqueous solution of sodium dodecyl sulfate maintained at 85° C. was added with the above monomer solution and subjected to high speed stirring by using "CLEAMIX" (manufactured by M Technique Co., Ltd.) to prepare an emulsion.

To a reaction vessel equipped with a stirrer, an inlet tube for nitrogen, a temperature sensor, and a condenser tube, the above emulsion was added and stirred under nitrogen stream after adjusting the internal temperature to 80° C. Then, an aqueous solution of polymerization initiator in which 4 parts by mass of potassium persulfate are dissolved in 50 parts by mass of deionized water and 1.37 parts by mass of n-octyl mercaptan were added dropwise thereto over 30 minutes. Then, the reaction was allowed to occur for 5 hours at 80° C. The internal temperature was further increased to 85° C. and the reaction was allowed to occur for 1 hour. After cooling to room temperature, a dispersion of amorphous resin microparticles [B1] was prepared.

The solid content concentration of the dispersion of amorphous resin microparticles [B1] was 20%, the average particle diameter was 210 nm, the weight average molecular weight (Mw) was 30,000, and the glass transition point was 45° C.

Preparation Example of Dispersion of Amorphous Resin Microparticles [B2]

By mixing 140 parts by mass of styrene, 50 parts by mass of n-butyl acrylate, 10 parts by mass of methacrylic acid, and 30 parts by mass of stearic stearate (melting point: 57° C.) and dissolving them while maintaining the temperature at 80° C., a monomer solution was obtained.

Meanwhile, 870 parts by mass of 0.5% aqueous solution of sodium dodecyl sulfate maintained at 80° C. was added with the above monomer solution and subjected to high speed stirring by using "CLEAMIX" (manufactured by M Technique Co., Ltd.) to prepare an emulsion.

To a reaction vessel equipped with a stirrer, an inlet tube for nitrogen, a temperature sensor, and a condenser tube, the above emulsion was added and stirred under nitrogen stream after adjusting the internal temperature to 80° C. Then, an aqueous solution of polymerization initiator in which 4 parts by mass of potassium persulfate are dissolved in 50 parts by mass of deionized water and 1.37 parts by mass of n-octyl mercaptan were added dropwise thereto over 30 minutes. Then, the reaction was allowed to occur for 5 hours at 80° C. The internal temperature was further increased to 85° C. and the reaction was allowed to occur for 1 hour. After cooling to room temperature, a dispersion of amorphous resin microparticles [B2] was prepared.

The solid content concentration of the dispersion of amorphous resin microparticles [B2] was 20%, the average particle diameter was 210 nm, the weight average molecular weight (Mw) was 30,000, and the glass transition point was 45° C.

Preparation Example of Dispersion of Amorphous Resin Microparticles [B3]

By mixing 160 parts by mass of styrene, 30 parts by mass of n-butyl acrylate, 10 parts by mass of methacrylic acid, and 30 parts by mass of pentaerythritol tetrabehenate (melting point: 82° C.) and dissolving them while maintaining the temperature at 85° C., a monomer solution was obtained.

Meanwhile, 870 parts by mass of 0.5% aqueous solution of sodium dodecyl sulfate maintained at 85° C. was added with the above monomer solution and subjected to high speed stirring by using "CLEAMIX" (manufactured by M Technique Co., Ltd.) to prepare an emulsion.

To a reaction vessel equipped with a stirrer, an inlet tube for nitrogen, a temperature sensor, and a condenser tube, the above emulsion was added and stirred under nitrogen stream after adjusting the internal temperature to 80° C. Then, an aqueous solution of polymerization initiator in which 4 parts by mass of potassium persulfate are dissolved in 50 parts by mass of deionized water and 1.37 parts by mass of n-octyl mercaptan were added dropwise thereto over 30 minutes. Then, the reaction was allowed to occur for 5 hours at 80° C. The internal temperature was further increased to 85° C. and the reaction was allowed to occur for 1 hour. After cooling to room temperature, a dispersion of amorphous resin microparticles [B3] was prepared.

The solid content concentration of the dispersion of amorphous resin microparticles [B3] was 20%, the average particle diameter was 200 nm, the weight average molecular weight (Mw) was 30,000, and the glass transition point was 65° C.

Preparation Example of Dispersion of Cyan Colorant Microparticles [C]

By adding 30 parts by mass of copper phthalocyanine (C.I. Pigment Blue 15:3) to an aqueous surfactant solution having 10 parts by mass of sodium dodecyl sulfate dissolved in 160 parts by mass of deionized water followed by stirring and performing high speed stirring by using "CLEAMIX" (manufactured by M Technique Co., Ltd.), the dispersion of cyan colorant microparticles [C] was obtained.

The solid content concentration of the dispersion of cyan colorant microparticles [C] was 15% and the average particle diameter was 210 nm.

Example 1

Manufacturing Example of Toner [1]

600 parts by mass of the dispersion of amorphous resin microparticles [B1], 150 parts by mass of the dispersion of urethane modified crystalline resin microparticles [A1] given with an ionic dissociating group, 45 parts by mass of the dispersion of cyan colorant microparticles [C], 500 parts by mass of deionized water, and 6.2 parts by mass of "Emal E27C (effective component: 27%)" were added to a reaction vessel equipped with a stirrer, a condenser tube, and a temperature sensor followed by mixing under stirring, and then the pH was adjusted to 10 by adding an aqueous 0.1 N sodium hydroxide solution. Then, an aqueous solution containing 20 parts by mass of magnesium chloride hexahydrate dissolved in 20 parts by mass of deionized water was further added under stirring and the internal temperature was increased to 80° C. The stirring was continued while maintaining 80° C. and the reaction was allowed to occur until the average particle diameter becomes 6.2 μm as determined by using a particle size distribution analyzer "Coulter Counter 3" (manufactured by Beckman Coulter, Inc.). When the particle diameter reaches 6.2 μm, an aqueous solution containing 1.5 parts by mass of sodium chloride dissolved in 7.5 parts by mass of deionized water was added and then cooled to room temperature when the circularity reaches 0.96, in which the circularity is measured by using a flow type particle image analyzer "FPIA-2100" (manufactured by Sysmex Corporation). The dispersion was repeatedly washed and filtered followed by drying to obtain the toner particle [1].

The average particle diameter of the toner particle [1] was 6.28 μm, the CV value was 19%, and the average circularity was 0.963.

The obtained toner particle [1] was added with 1% by mass of hydrophobic silica (number average primary particle diameter=10 nm, and hydrophobicity=60) and mixed by using "Henschel mixer" (manufactured by Mitsui Miike Machinery Co., Ltd.). After that, the coarse particles were removed by using a sieve with 45 μm mesh, and thus the toner [1] was obtained.

Examples 2 to 10

Manufacturing Example of Toners [2] to [10]

The toners [2] to [10] were obtained in the same manner as the manufacturing example of toner [1] except that the dispersions of urethane modified crystalline resin microparticles [A2] to [A10] given with an ionic dissociating group were used instead of the dispersion of urethane modified crystalline resin microparticles [A1] given with an ionic dissociating group, and hydrophobic silica is mixed in the same manner as the preparation example of the toner [1].

The average particle diameter, CV value, and average circularity of the toner particles [2] to [10] are shown in the following Table 3.

TABLE 3

| Toner particle No. | Average particle diameter (μm) | CV value (%) | Average circularity | Tg (° C.) | Melting point of urethane modified crystalline resin (° C.) | Melting point of releasing agent (° C.) |
|---|---|---|---|---|---|---|
| [1] | 6.28 | 19 | 0.963 | 45 | 66 | 82 |
| [2] | 6.31 | 22 | 0.961 | 45 | 65 | 82 |
| [3] | 6.53 | 19 | 0.969 | 43 | 66 | 82 |
| [4] | 6.61 | 21 | 0.961 | 45 | 68 | 82 |
| [5] | 6.75 | 18 | 0.963 | 45 | 63 | 82 |
| [6] | 6.72 | 21 | 0.971 | 44 | 53 | 82 |
| [7] | 6.37 | 24 | 0.967 | 45 | 73 | 82 |
| [8] | 6.55 | 21 | 0.966 | 45 | 72 | 82 |
| [9] | 6.14 | 24 | 0.961 | 45 | 65 | 82 |
| [10] | 6.85 | 19 | 0.973 | 45 | 66 | 82 |
| [11] | 6.02 | 23 | 0.969 | 65 | 54 | 82 |
| [12] | 6.52 | 20 | 0.966 | 45 | 67 | 57 |
| [13] | 6.32 | 21 | 0.968 | 45 | — | 82 |
| [14] | 6.12 | 24 | 0.954 | 45 | Not observed | 82 |

Example 11

Manufacturing Example of Toner [11]

600 parts by mass of the dispersion of amorphous resin microparticles [B3], 150 parts by mass of the dispersion of urethane modified crystalline resin microparticles [A4] given with an ionic dissociating group, 45 parts by mass of the dispersion of cyan colorant microparticles [C], 500 parts by mass of deionized water, and 6.2 parts by mass of "Emal E27C (effective component: 27%)" were added to a reaction vessel equipped with a stirrer, a condenser tube, and a temperature sensor followed by mixing under stirring, and then the pH was adjusted to 10 by adding an aqueous 0.1 N sodium hydroxide solution. Then, an aqueous solution containing 20 parts by mass of magnesium chloride hexahydrate dissolved in 20 parts by mass of deionized water was further added under stirring and the internal temperature was increased to 80° C. The stirring was continued while maintaining 80° C. and the reaction was allowed to occur until the average particle diameter becomes 6.2 μm as determined by using a particle size distribution analyzer "Coulter Counter 3" (manufactured by Beckman Coulter, Inc.). When the particle diameter reaches 6.2 μm, an aqueous solution containing 1.5 parts by mass of sodium chloride dissolved in 7.5 parts by mass of deionized water was added and then cooled to room temperature when the circularity reaches 0.96, in which the circularity is measured by using a flow type particle image analyzer "FPIA-2100" (manufactured by Sysmex Corporation). The dispersion was repeatedly washed and filtered followed by drying to obtain the toner particle [11].

The average particle diameter of the toner particle [11] was 6.02 μm, the CV value was 23%, and the average circularity was 0.969.

The obtained toner particle [11] was added with 1% by mass of hydrophobic silica (number average primary particle diameter=10 nm, and hydrophobicity=60) and mixed by using "Henschel mixer" (manufactured by Mitsui Miike Machinery Co., Ltd.). After that, the coarse particles were removed by using a sieve with 45 μm mesh, and thus the toner [11] was obtained.

Example 12

Manufacturing Example of Toner [12]

The toner [12] was obtained in the same manner as the manufacturing example of toner [1] except that the dispersion of amorphous resin microparticles [B2] given with an ionic dissociating group was used instead of the dispersion of amorphous resin microparticles [B1] given with an ionic dissociating group, and hydrophobic silica was mixed in the same manner as the preparation example of the toner [1].

The average particle diameter of the toner particle [12] was 6.52 μm, the CV value was 20%, and the average circularity was 0.966.

Comparative Example 1

Manufacturing Example of Toner [13]

750 parts by mass of the dispersion of amorphous resin microparticles [B1], 45 parts by mass of the dispersion of cyan colorant microparticles [C], 500 parts by mass of deionized water, and 6.2 parts by mass of "Emal E27C (effective component: 27%)" were added to a reaction vessel equipped with a stirrer, a condenser tube, and a temperature sensor followed by mixing under stirring, and then the pH was adjusted to 10 by adding an aqueous 0.1 N sodium hydroxide solution. Then, an aqueous solution containing 20 parts by mass of magnesium chloride hexahydrate dissolved in 20 parts by mass of deionized water was further added under stirring and the internal temperature was increased to 80° C. The stirring was continued while maintaining 80° C. and the reaction was allowed to occur until the average particle diameter becomes 6.2 μm as determined by using a particle size distribution analyzer "Coulter Counter 3" (manufactured by Beckman Coulter, Inc.). When the particle diameter reaches 6.2 μm, an aqueous solution containing 1.5 parts by mass of sodium chloride dissolved in 7.5 parts by mass of deionized water was added and then cooled to room temperature when the circularity reaches 0.96, in which the circularity is measured by using a flow type particle image analyzer "FPIA-2100" (manufactured by Sysmex Corporation). The dispersion was repeatedly washed and filtered followed by drying to obtain the toner particle [13] for comparison.

The average particle diameter of the toner particle [13] was 6.32 μm, the CV value was 21%, and the average circularity was 0.968.

The obtained toner particle [13] was added with 1% by mass of hydrophobic silica (number average primary particle diameter=10 nm, and hydrophobicity=60) and mixed by using "Henschel mixer" (manufactured by Mitsui Miike Machinery Co., Ltd.). After that, the coarse particles were removed by using a sieve with 45 μm mesh, and thus the toner [13] was obtained.

Comparative Example 2

Manufacturing Example of Toner [14]

The comparative toner [14] was obtained in the same manner as the manufacturing example of toner [1] except that the dispersion of urethane modified crystalline resin microparticles [A12] given with an ionic dissociating group was used instead of the dispersion of urethane modified crystalline resin microparticles [A1] given with an ionic dissociating group, and hydrophobic silica was mixed in the same manner as the preparation example of the toner [1].

The average particle diameter of the toner particle [14] was 6.12 μm, the CV value was 24%, and the average circularity was 0.959.

An endothermic amount ΔH1 (J/g) based on an endothermic peak derived from the urethane modified crystalline resin during a first temperature increasing process for increasing the temperature from 0° C. to 200° C. by differential scanning calorimetry and an endothermic amount ΔH2 (J/g) based on an endothermic peak derived from the urethane modified crystalline resin during a second temperature increasing process for increasing the temperature from 0° C. to 200° C. by differential scanning calorimetry were measured for the toners [1] to [14], and then ΔH1/(ΔH0×(A/100)) and ΔH2/ΔH1 were calculated. The results are shown in Table 4.

Meanwhile, it was not possible to obtain the endothermic amount ΔH1 and ΔH2 from the toner [14] for comparison. It is believed due to the reason that the urethane modified crystalline resin microparticles given with an ionic dissociating group have not been added to the toner particle [14].

TABLE 4

| | Toner No. | Urethane modified crystalline resin given with ionic dissociating group No. | Content ratio (wt %) | ΔH1/(ΔH0 × (A/100)) | ΔH2/ΔH1 |
|---|---|---|---|---|---|
| Example 1 | [1] | [A1] | 30 | 0.95 | 0.96 |
| Example 2 | [2] | [A2] | 30 | 0.97 | 0.95 |
| Example 3 | [3] | [A3] | 30 | 0.95 | 0.97 |
| Example 4 | [4] | [A4] | 30 | 0.86 | 0.82 |

TABLE 4-continued

| | Toner No. | Urethane modified crystalline resin given with ionic dissociating group No. | Content ratio (wt %) | ΔH1/(ΔH0 × (A/100)) | ΔH2/ΔH1 |
|---|---|---|---|---|---|
| Example 5 | [5] | [A5] | 30 | 0.98 | 0.99 |
| Example 6 | [6] | [A6] | 30 | 0.92 | 0.91 |
| Example 7 | [7] | [A7] | 30 | 0.97 | 0.95 |
| Example 8 | [8] | [A8] | 30 | 0.99 | 1 |
| Example 9 | [9] | [A9] | 30 | 0.87 | 0.94 |
| Example 10 | [10] | [A10] | 30 | 1 | 0.95 |
| Example 11 | [11] | [A4] | 30 | 0.65 | 0.7 |
| Example 12 | [12] | [A1] | 30 | 0.93 | 0.89 |
| Comparative Example 1 | [13] | — | — | — | — |
| Comparative Example 2 | [14] | [A12] | (30) | — | — |

Manufacturing Examples of Developers 1 to 14

By adding ferrite carrier with a volume average particle diameter of 35 μm which is coated with an acrylic resin to each of the toners [1] to [14] such that the toner concentration is 6% by mass followed by mixing, the developers [1] to [14] were manufactured.

The developers [1] to [14] were subjected to the following evaluations.

(1) Low Temperature Fixability

By using "BizHab" (manufactured by Konica Minolta, Inc.) which was modified to have variable fixing temperature and fixing speed, a solid image with a toner adhesion amount of 9 g/m$^2$ was printed. After fixing each of them with a linear speed of 420 mm/sec at a fixing temperature from 180° C. to 100° C. which is set at every 5° C., the image part was subjected to valley fold and the lowest fixing temperature among the fixing temperatures at which the width of peeling off image shown on the folding line is 0.5 mm or less is determined as the minimum fixing temperature (MFT).

The results are shown in Table 5. When the minimum fixing temperature is 140° C. or lower, it is evaluated as "pass" in the present invention.

(2) Glossiness

By using "BizHab PRO C6000L" (manufactured by Konica Minolta, Inc.), a solid image with a toner adhesion amount of 9 g/m$^2$ was printed. Then, the fixing was performed with a linear speed of 100 mm/sec and 420 mm/sec at a fixing temperature of 180° C. The glossiness of the obtained fixed image at light incident angle of 75 degrees was measured by using "Gloss Meter GM-26D" (manufactured by Murakami Color Research Laboratory).

The results are shown in Table 5. When the glossiness is 25 or less when the linear speed for fixing is 100 mm/sec and the glossiness is 22 or less when the linear speed for fixing is 420 mm/sec, it is evaluated as "pass" in the present invention.

(3) Document Off-Set Resistance

By using "BizHab" (manufactured by Konica Minolta, Inc.), two solid images with a toner adhesion amount of 9 g/m$^2$ were printed. Then, the fixing was performed with a linear speed of 420 mm/sec at a fixing temperature from 150° C. The images obtained after fixing were overlapped such that the image parts face each other, and after applying a load with a weight of 80 g/cm$^2$ or so, they were kept for 3 days in an environment with a temperature of 60° C. and a humidity of 50% RH. Then, the overlapped two fixed images were peeled off and the image defect was evaluated according to the following evaluation criteria.

The results are shown in Table 5. In the present invention, "G5" to "G3" are found as "pass".

—Evaluation Criteria—

G1: The paper itself to which the image part is fixed is peeled, and thus there are significant image defects and clear image transfer to a non-image part.

G2: There are several occurrences of white spot as image defects in many areas of the image part.

G3: Although there is a rough image or reduced glossiness on the image surface, image defects are hardly seen and thus it corresponds to an admissible level. There is slight image transfer on a non-image part.

G4: There is crispy sound when two overlapped fixed images are peeled and slight image transfer is shown on a non-image part. However, as having no image defects, it corresponds to a level with no problem at all.

G5: Absolutely no image defects or image transfer are shown in any one of the image part and non-image part.

TABLE 5

| | Toner No. | Minimum fixing temperature (° C.) | Glossiness 100 mm/sec | Glossiness 420 mm/sec | Document off-set resistance |
|---|---|---|---|---|---|
| Example 1 | [1] | 115 | 18 | 16 | G5 |
| Example 2 | [2] | 120 | 20 | 18 | G5 |
| Example 3 | [3] | 125 | 18 | 15 | G5 |
| Example 4 | [4] | 130 | 23 | 15 | G4 |
| Example 5 | [5] | 120 | 21 | 17 | G5 |
| Example 6 | [6] | 125 | 25 | 20 | G5 |
| Example 7 | [7] | 110 | 19 | 15 | G5 |
| Example 8 | [8] | 115 | 24 | 21 | G5 |
| Example 9 | [9] | 125 | 21 | 17 | G4 |
| Example 10 | [10] | 120 | 20 | 15 | G5 |
| Example 11 | [11] | 135 | 23 | 17 | G3 |
| Example 12 | [12] | 140 | 20 | 16 | G3 |
| Comparative Example 1 | [13] | 155 | 28 | 13 | G2 |
| Comparative Example 2 | [14] | 150 | 27 | 14 | G1 |

It was confirmed that the toner according to the examples of the present invention has excellent low temperature fixability and stable glossiness of fixed images without having a significant difference even when the linear speed for fixing is different, and thus excessively high glossiness is not shown. It was also confirmed that the document off-set resistance is good.

Meanwhile, the toner according to Comparative Example 1 containing no urethane modified crystalline resin was found to have poor low temperature fixability and a significant difference in glossiness of fixed images under different linear speed for fixing. Further, the toner according to Comparative Example 2 containing an urethane modified crystalline resin with an excessively high amount of an ionic dissociating group was found to have unfavorable low temperature fixability, stability of glossiness, and document off-set resistance, which are comparable to those of the toner not containing the urethane modified crystalline resin.

What is claimed is:

1. A toner for electrostatic charge image development comprising toner particles comprising a binder resin, a colorant, and a releasing agent, wherein the binder resin comprises at least an amorphous resin and an urethane modified crystalline resin comprising a crystalline polymer segment and an urethane polymer segment bound to each other, the urethane modified crystalline resin being non-compatible with the amorphous resin, and the amount of an ionic dissociating group of the urethane modified crystalline resin is 5 to 20 mgKOH/g.

2. The toner for electrostatic charge image development according to claim 1, wherein the following relational formula (1) is satisfied when a glass transition point of the amorphous resin is TgA, a melting point of the urethane modified crystalline resin is TmC, and a melting point of the releasing agent is TmW:

$$TgA \leq TmC < TmW. \quad \text{Relational formula (1)}$$

3. The toner for electrostatic charge image development according to claim 1, wherein the following relational formula (2) and the relational formula (3) are satisfied when an endothermic amount of the toner for electrostatic charge image development, which is based on an endothermic peak derived from the urethane modified crystalline resin during a first temperature increasing process for increasing the temperature from 0° C. to 200° C. in differential scanning calorimetry, is ΔH1 (J/g), an endothermic amount of the toner for electrostatic charge image development, which is based on an endothermic peak derived from the urethane modified crystalline resin during a second temperature increasing process for increasing the temperature from 0° C. to 200° C. in the differential scanning calorimetry, is ΔH2 (J/g), an endothermic amount of the urethane modified crystalline resin only, which is based on an endothermic peak during the second temperature increasing process for increasing the temperature from 0° C. to 200° C. in differential scanning calorimetry, is ΔH0 (J/g), and a content ratio of the urethane modified crystalline resin in the toner particles is A (% by mass):

$$0.75 \leq \Delta H1/(\Delta H0 \times (A/100)) \leq 1.0 \quad \text{Relational formula (2)}$$

$$0.75 \leq \Delta H2/\Delta H1 \leq 1.0. \quad \text{Relational formula (3)}$$

4. The toner for electrostatic charge image development according to claim 1, wherein a carboxylic acid group and/or a sulfonic acid group is comprised at a molecular terminal of the urethane modified crystalline resin and/or in the urethane polymer segment constituting the urethane modified crystalline resin.

5. The toner for electrostatic charge image development according to claim 1, wherein the peak temperature of an endothermic peak derived from the urethane modified crystalline resin during a second temperature increasing process for increasing the temperature from 0° C. to 200° C. in differential scanning calorimetry of the urethane modified crystalline resin only is in the range of 50 to 85° C.

6. The toner for electrostatic charge image development according to claim 1, wherein the crystalline polymer segment constituting the urethane modified crystalline resin comprises a crystalline polyester polymer.

7. The toner for electrostatic charge image development according to claim 1, wherein the amorphous resin is a styrene acrylic resin and/or a polyester resin.

8. A method for manufacturing a toner for electrostatic charge image development comprising toner particles comprising a binder resin, a colorant, and a releasing agent, the method comprising:

aggregating and fusing microparticles comprising an amorphous resin for forming the binder resin and microparticles comprising an urethane modified crystalline resin for forming the binder resin, which is obtained by binding a crystalline polymer segment and an urethane polymer segment and is non-compatible with the amorphous resin, the microparticles being dispersed in an aqueous medium, and using, as the urethane modified crystalline resin, a resin having an ionic dissociating group amount of 5 to 20 mgKOH/g.

* * * * *